US008353512B2

(12) United States Patent
Masuda et al.

(10) Patent No.: US 8,353,512 B2
(45) Date of Patent: Jan. 15, 2013

(54) SHEET FEEDER

(75) Inventors: Junya Masuda, Osaka (JP); Koji Wakamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/301,357

(22) Filed: Nov. 21, 2011

(65) Prior Publication Data

US 2012/0126473 A1 May 24, 2012

(30) Foreign Application Priority Data

Nov. 22, 2010 (JP) ..... 2010-259955

(51) Int. Cl.
*B65H 39/10* (2006.01)

(52) U.S. Cl. ..... 271/301; 27/65; 27/186

(58) Field of Classification Search ..... 271/186, 271/65, 291, 301
See application file for complete search history.

(56) References Cited

FOREIGN PATENT DOCUMENTS

| | | | |
|---|---|---|---|
| JP | 05-097305 | A | 4/1993 |
| JP | 2001-225995 | A | 8/2001 |
| JP | 2002-274730 | A | 9/2002 |
| JP | 2008-110844 | A | 5/2008 |

*Primary Examiner* — Michael McCullough
(74) *Attorney, Agent, or Firm* — Birch, Stewart, Kolasch & Birch, LLP

(57) ABSTRACT

A switch back path is connected to a sheet feed path through a branch portion. A plurality of pairs of forward and backward rotating rollers are disposed along the switch back path from the branch portion. A driving portion selectively supplies rotation of a forward rotation direction or of a backward rotation direction to a plurality of pairs of forward and backward rotating rollers. A separation mechanism separates a first pair of forward and backward rotating rollers from each other. A control portion controls operation of the driving portion and the separation mechanism so that a sheet to be fed into the switch back path and a sheet to be fed out of the switch back path pass each other in the switch back path.

10 Claims, 24 Drawing Sheets

FIG.8A

301

| | VALUE SET TO TIMER Tg | |
|---|---|---|
| LENGTH L OF FEED DIRECTION OF SHEET | FACE-UP MODE | FACE-DOWN MODE |
| L≤A4 HORIZONTAL LENGTH | tgu1 | tgd1 |
| A4 HORIZONTAL LENGTH<L≤B4 VERTICAL LENGTH | tgu2 | tgd2 |
| B4 VERTICAL LENGTH<L≤A3 VERTICAL LENGTH | tgu3 | tgd3 |

Fig.8B

302

| LENGTH L OF FEED DIRECTION OF SHEET | Tx |
|---|---|
| L≤A4 HORIZONTAL LENGTH | tx1 |
| A4 HORIZONTAL LENGTH<L≤B4 VERTICAL LENGTH | tx2 |
| B4 VERTICAL LENGTH<L≤A3 VERTICAL LENGTH | tx3 |

Fig.8C

303

| LENGTH L OF FEED DIRECTION OF SHEET | Ty |
|---|---|
| A4 HORIZONTAL LENGTH≤L<B4 VERTICAL LENGTH | ty1 |
| B4 VERTICAL LENGTH≤L<A3 VERTICAL LENGTH | ty2 |
| L≤A3 VERTICAL LENGTH | ty3 |

SHEET FEEDER

CROSS REFERENCE

This Nonprovisional application claims priority under 35 U.S.C. §119(a) on Patent Application No. 2010-259955 filed in Japan on Nov. 22, 2010, the entire contents of which are hereby incorporated by reference.

BACKGROUND OF THE INVENTION

The present invention relates to a sheet feeder having a switch back path for reversing a feed direction of a sheet.

For an image forming apparatus for performing double-sided image formation processing to a sheet, a sheet feeder having a switch back path for reversing a first surface and a second surface of the sheet by reversing the front and rear of the feed direction of the sheet is used. The sheet feeder feeds in a sheet with an image formed on the first side thereof in an image forming portion to a switch back path, and then feeds out the sheet from the switch back path in a direction opposite to a direction in which the sheet is fed in. The sheet fed out of the switch back path has the first surface and the second surface thereof reversed so that an image is formed on the second surface, and then is fed to the image forming portion.

When the double-sided image formation processing to a plurality of sheets is performed successively, performing the double-sided image formation processing to all sheets requires a long time in a case where a succeeding sheet is fed into a switch back path after a preceding sheet is fed out of the switch back path.

In view of the foregoing, some conventional sheet feeders, as described by Japanese Patent Laid-Open publication No. 05-97305 for example, are configured to feed a sheet being fed out and a succeeding sheet being fed in each other in opposite directions in a switch back path.

The switch back path is connected to a part of the sheet feed path through a branch portion, a sheet is fed into the switch back path via the branch portion from the upstream side of the branch portion in the sheet feed path, and the sheet is fed out of the switch back path to the downstream side of the branch portion in the sheet feed path via the branch portion. At the branch portion, a pair of upstream side rollers and a pair of downstream side rollers that share a driving roller is disposed. The switch back path is provided with a pair of reversing rollers including a reversing driving roller capable of freely rotating both in a forward direction and in a backward direction and a reversing driven roller capable of freely contacting and separating from the reversing driving roller.

In a state where the reversing driven roller is in contact with the reversing driving roller being forward rotating in a feed-in direction, a sheet is fed into the switch back path via the pair of upstream side rollers from the sheet feed path, and fed out by backward rotating the reversing driving roller in a feed-out direction after the rear end of the sheet has passed the branch portion. When the leading edge of the sheet being fed out of the switch back path has reached the pair of downstream side rollers, the reversing driven roller is separated from the reversing driving roller. During a period from a time when the rear end of the sheet being fed out has passed the pair of reversing rollers until a time when the rear end of the sheet being fed in reaches the pair of upstream side rollers, the reversing driving roller is forward rotated in the feed-in direction, and the reversing driven roller is made to be in contact with the reversing driving roller.

The conventional sheet feeders separate the reversing driven roller from the reversing driving roller every time when the leading edge of a sheet being fed out reaches the pair of downstream side rollers, and makes the reversing driven roller to be in contact with the reversing driving roller every time when the rear end of a sheet being fed in reaches the pair of upstream side rollers. In successively performing the double-sided image forming processing to a plurality of sheets, every time when a sheet is fed in and fed out of the switch back path, it is necessary to make the reversing driven roller repeatedly contact and separate from the reversing driven roller so that control of a contact/separation mechanism of the reversing driven roller becomes complicated.

It is an object of the present invention to provide a sheet feeder capable of eliminating a contact/separation operation of a reversing driven roller to a reversing driving roller in successively performing double-sided image forming processing to a plurality of sheets, and capable of simplifying control of the contact/separation mechanism of the reversing driven roller.

SUMMARY OF THE INVENTION

A sheet feeder of the present invention includes a switch back path, a branch portion, a first feed member, a second feed member, a plurality of pairs of forward and backward rotating rollers, a driving portion, and a separation mechanism, and a control portion. The switch back path feeds a sheet forwards and backwards in order to reverse the first surface and the second surface of the sheet, and is connected to the sheet feed path through the branch portion. The first feed member is disposed at the upstream side of the branch portion in the sheet feed path. The second feed member is disposed at the downstream side of the branch portion in the sheet feed path. The plurality of pairs of forward and backward rotating rollers are provided in the switch back path sequentially from the branch portion, and composed of a first pair of forward and backward rotating rollers located close to the branch portion, and the second pairs of forward and backward rotating rollers except the first pair of forward and backward rotating rollers. The driving portion rotates the plurality of pairs of forward and backward rotating rollers selectively in either the forward direction or the backward direction. The separation mechanism separates the first pair of forward and backward rotating rollers from each other. The control portion has a structure for controlling the operation of the driving portion and the separation mechanism so that the sheet being fed into the switch back path and the sheet being fed out of the switch back path can pass each other in the switch back path.

The foregoing and other features and attendant advantages of the present invention will become more apparent from the reading of the following detailed description of the invention in conjunction with the accompanying drawings.

BRIEF DESCRIPTION OF THE DRAWINGS

FIGS. 8A to 8C are views showing an example of a table showing the relationship between a length of a sheet in a feed direction and a setting time of a timer;

DETAILED DESCRIPTION OF THE INVENTION

Figure 1:
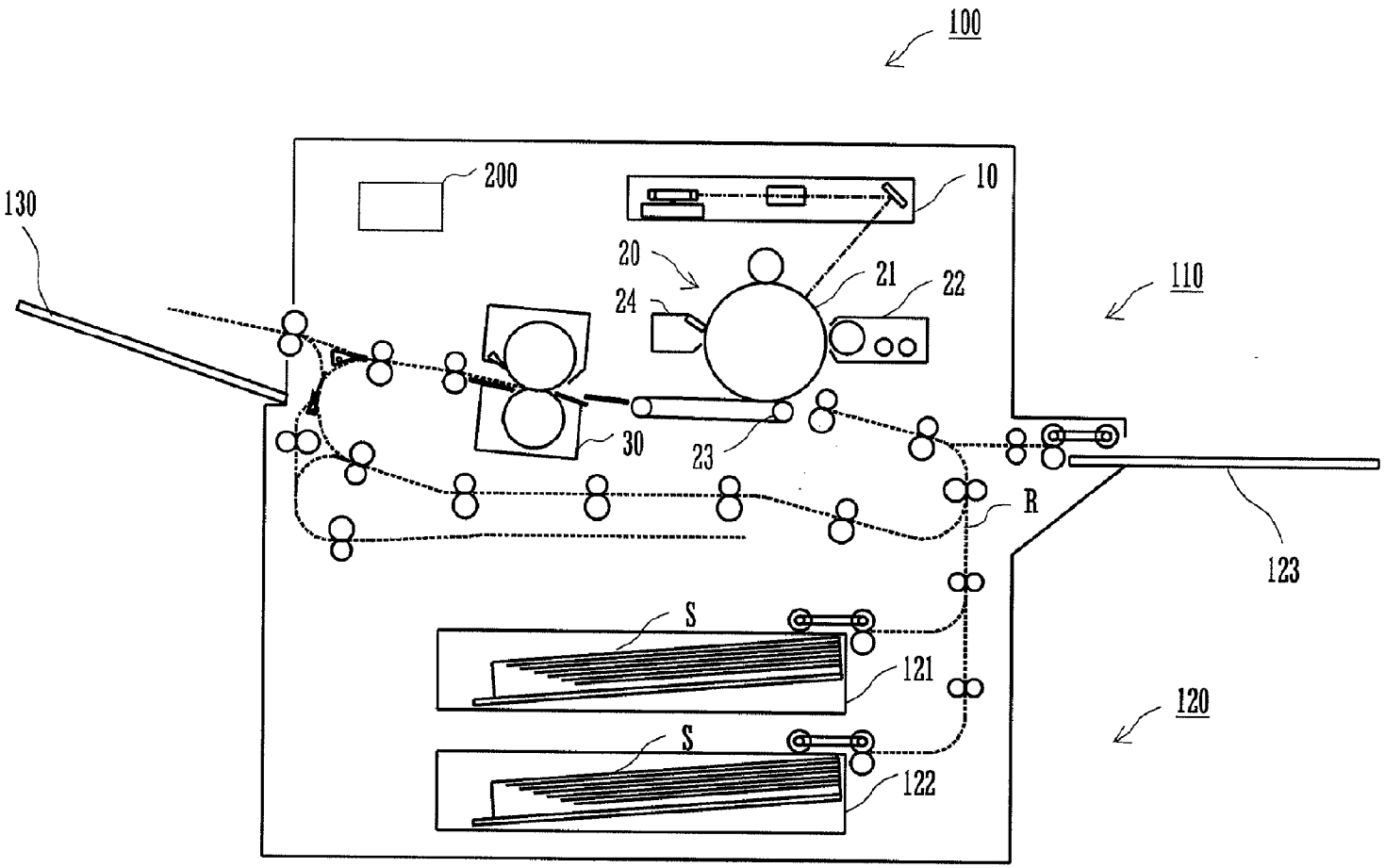
FIG. 1 is a schematic view of an image forming apparatus provided with a sheet feeder according to an embodiment of the present invention.

The following describes an image forming apparatus 100 provided with a sheet feed path R according to the present invention, with reference to FIG. 1. As shown in FIG. 1, an image forming apparatus 100 is provided with an image forming portion 110, a sheet feed portion 120, a sheet output portion 130, a control portion 200, a storage portion 300 (see FIG. 7), and an operating portion (corresponding to a receiving portion of the present invention) 400 (see FIG. 7). The image forming apparatus 100 forms an image on a predetermined sheet S based on input image data in response to an instruction provided by the control portion 200.

The image forming portion 110 is provided with an exposure unit 10, an image forming unit 20 for forming a toner image on the sheet S, and a fixing unit 30 for fixing and fusing the toner image onto the sheet S. The exposure unit 10 drives a semiconductor laser based on the input image data, distributes laser beam to a photoreceptor drum 21, and forms an electrostatic latent image corresponding to the image data on the photoreceptor drum 21. The exposure unit 10 may employ a light source including an LED array configured to be driven based on image data, other than the semiconductor laser.

The image forming unit 20 includes, around the photoreceptor drum 21, a developing device 22 for visualizing an electrostatic latent image formed on the photoreceptor drum 21 into a toner image by supplying toner to the electrostatic latent image, a transfer device 23 for transferring the toner image formed on the surface of the photoreceptor drum 21 onto the sheet S, and a cleaning device 24 for recovering toner that is not transferred onto the sheet, from the surface of the photoreceptor drum 21. The toner image transferred to the sheet S is heated and pressurized by the fixing unit 30, and then is fixed and fused onto the sheet S.

The sheet feed portion 120 is disposed at a lower part of the image forming portion 110, and includes sheet feed cassettes 121 and 122 capable of storing a plurality of sheets S, a manual feed tray 123 designed to allow the sheets S to be placed thereon, and a sheet feed path R. The sheet feed path R is formed to extend from the sheet feed cassettes 121,122 and the manual feed tray 123 up to the sheet output portion 130.

Figure 2:
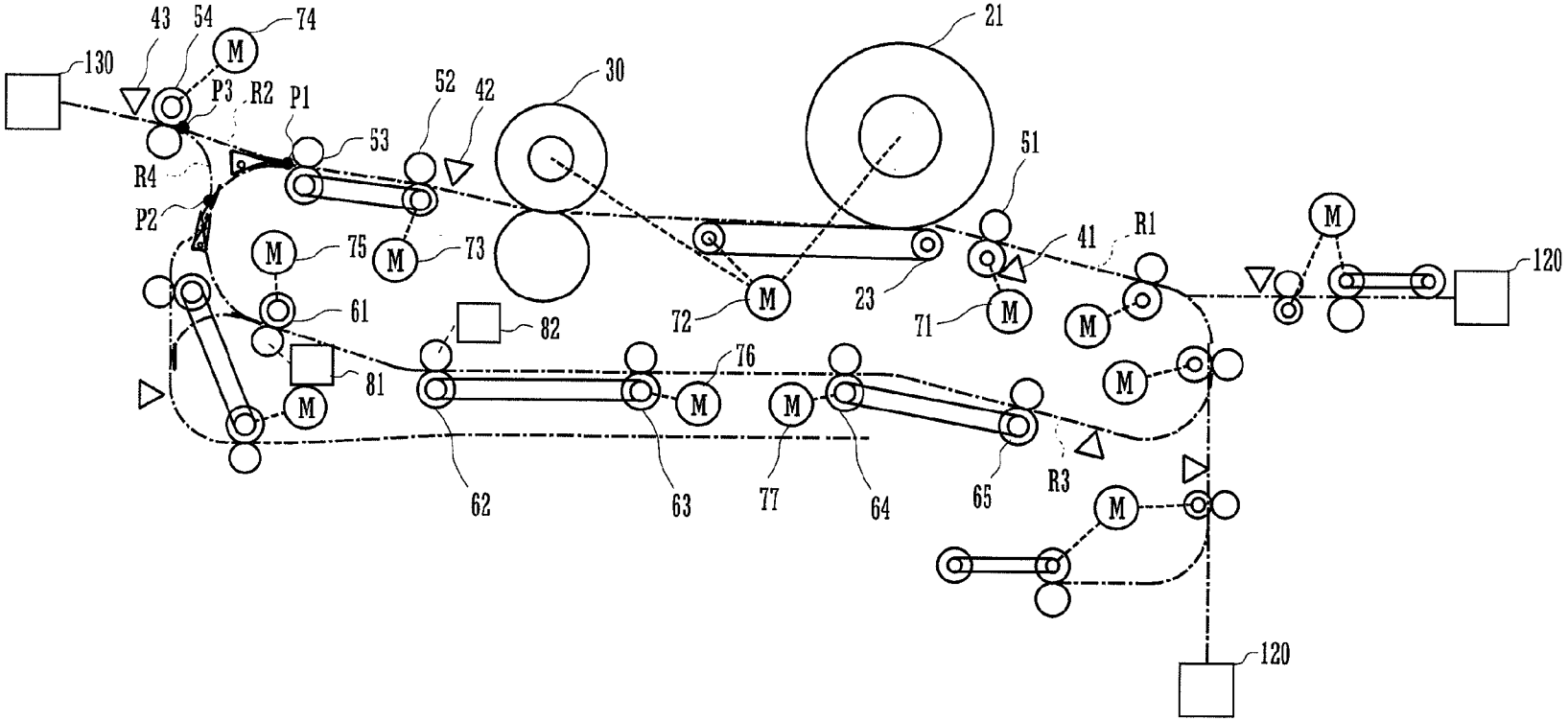
FIG. 2 is a schematic view of a sheet feed path of the sheet feeder.

The sheet feed path R includes, as shown in FIG. 2, a sheet guide path R1, a first sheet output path R2, a second sheet output path R4, and a switch back path R3. The sheet guide path R1 is formed from the sheet feed portion 120 up to the branch point P2 through a space between the photoreceptor drum 21 and the transfer device 23, a space between the fixing unit 30, and the branch point P1. The first sheet output path R2 is formed from the branch point P1 to the sheet output portion 130. The second sheet output path R4 is formed from the branch point P2 to a junction point P3 where the path joints the first sheet output path R2. The switch back path R3 is formed from the branch point P2 up to a lower part of the sheet guide path R1. The branch point P1 is a position where the sheet guide path R1 branches off to the first sheet output path R2 or to the switch back path R3. The branch point (corresponding to a branch portion of the present invention) P2 is a position where the sheet guide path R1, the second sheet output path R4, and the switch back path R3 are connected. The junction point P3 is a position located in the upstream side of a pair of feed rollers 54 on the first sheet output path R2, and a position where the second sheet output path R4 joins the first sheet output path R2.

Along the sheet guide path R1, a sensor 41, a pair of feed rollers 51, a photoreceptor drum 21, a fixing unit 30, a sensor 42, a pair of feed rollers 52, and a pair of feed rollers (corresponding to a first feed member of the present invention) 53 are disposed in order from the upstream side of the path.

The sensor 41 is disposed at the upstream side of the photoreceptor drum 21, and detects the passage of the leading edge and the rear end of the sheet S before image formation processing. The sensor 42 is disposed near the downstream side of the fixing unit 30, detects the passage of the rear end of the sheet S, and then detects that the image formation processing to the sheet has completed. The image formation processing to a sheet includes transfer of a toner image from the photoreceptor drum 21 to a sheet, and fixing of the toner image to the sheet by the fixing unit 30.

The pair of feed rollers 51 is connected to a motor 71, and the photoreceptor drum 21 and the fixing unit 30 are connected to a motor 72. The pair of feed rollers 51, the photoreceptor drum 21, and the fixing unit 30 feed the sheet S from the upstream side toward the downstream side in the sheet feed path R1 at a first feed speed (corresponding to a first speed of the present invention), respectively, at the time of rotation of the motors 71 and 72 at the first speed. The pair of feed rollers 51 aligns leading edges of sheets so that the sheets can become parallel with a rotating shaft of the photoreceptor drum 21, and the rotation of the rollers is controlled so as to transfer the toner image on the photoreceptor drum 21 to a predetermined position of the sheet.

The pairs of feed rollers 52 and 53 are connected to a motor 73 and rotate at the first speed or at a second speed faster than the first feed speed. The pairs of feed rollers 52 and 53 feed a sheet S from the upstream side toward the downstream side in the sheet feed path R1 at the first feed speed at the time of rotation at the first speed. The pairs of feed rollers 52 and 53 feed a sheet S from the upstream side toward the downstream side in the sheet feed path R1 at a second feed speed (corresponding to a second speed of the present invention) faster than the first feed speed at the time of rotation at the second speed.

Along the first sheet output path R2, a pair of feed rollers (corresponding to a second feed member of the present invention) 54 and a sensor 43 are disposed in order from the upstream side of the path.

The pair of feed rollers 54 is connected to a motor 74 and rotates at the first speed or at the second speed. The pair of feed rollers 54, at the time of rotation at the first speed, feeds a sheet S from the upstream side toward the downstream side within the first sheet output path R2 at the first feed speed, and feeds the sheet from the upstream side toward the downstream side in the first sheet output path R2 at the second feed speed at the time of rotation at the second speed. The sensor 43 is disposed at the downstream side of the pair of feed rollers 54 on the first sheet output path R2. The sensor 43 detects the leading edge of the sheet S, detects that the sheet S is nipped by the pair of feed rollers 54, and furthermore detects the passage of the rear end of the sheet S and then detects first/second surface reversal processing to the sheet S has completed.

Along the switch back path R3, pairs of forward and backward rotating rollers 61 to 65 are disposed in order from the branch point P2.

The pair of forward and backward rotating roller 61 is connected to a motor 75, pairs of forward and backward rotating rollers 62 and 63 are connected to a motor 76, and pairs of forward and backward rotating rollers 64 and 65 are connected to a motor 77. The pairs of forward and backward rotating rollers 61 to 65 are pairs of rollers capable of forward and backward rotating, and forward and backward rotate at the first speed or at the second speed, respectively. The pairs of forward and backward rotating rollers 61 to 65 feed a sheet S so as to guide the sheet to the switch back path R3 at the first feed speed at the time of forward rotating at the first speed, respectively, and feed the sheet S so as to guide the sheet to the switch back path R3 at the second feed speed at the time of forward rotating at the second speed. The pairs of forward and backward rotating rollers 61 to 65 feed a sheet S so as to send the sheet from the switch back path R3 at the first feed speed at the time of backward rotating at the first speed, respectively, and feed the sheet S so as to send the sheet from the switch back path R3 at the second feed speed at the time of backward rotating at the second speed.

The pairs of forward and backward rotating rollers (corresponding to a first pair of forward and backward rotating rollers of the present invention) 61 and 62 are kept separated or kept contacted by separation portions 81 and 82, respectively. Since the pairs of forward and backward rotating rollers 61 and 62 have the same configuration, only the pair of forward and backward rotating rollers 61 and the separation portion 81 will be described below.

As shown in FIG. 3, the pair of forward and backward rotating roller 61 has a driving roller 61A and a driven roller 61B, and is disposed in a position where a driving roller 61A and a driven roller 61B are opposed each other across the switch back path R3.

The separation portion 81 includes an arm 811, a tension spring (corresponding to a biasing member of the present invention) 812, and a solenoid 813. The arm 811 is pivotably mounted to a substrate (not shown) at the side of the driven roller 61B of the switch back path R3, the arm having a first end as a pivot shaft 811A. The driven roller 61B is mounted near the center of the arm 811. At a second end of the arm 811, an elongated hole 811B and a mounting portion 811C are formed adjacently. The solenoid 813 is mounted to the elongated hole 811B, and the tension spring 812 that gives a biasing force to the driving roller 61A is mounted to the mounting portion 811C.

Figure 3A:
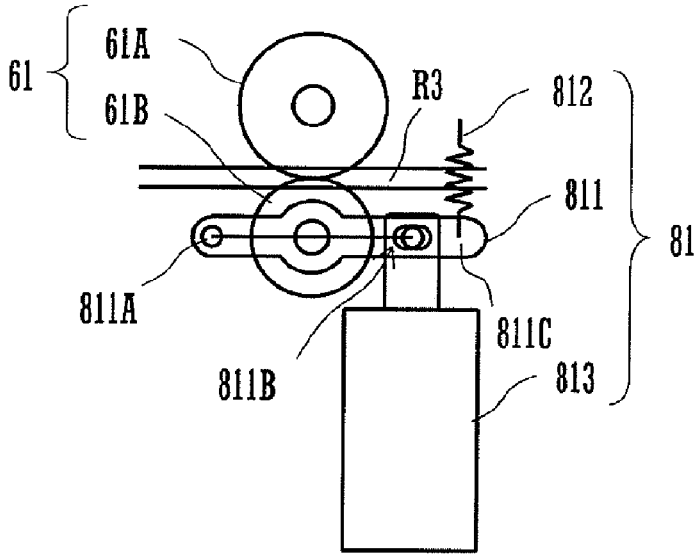
FIG. 3A and FIG. 3B are views illustrating an operation of a contact/separation mechanism of the sheet feeder.
Figure 3B:
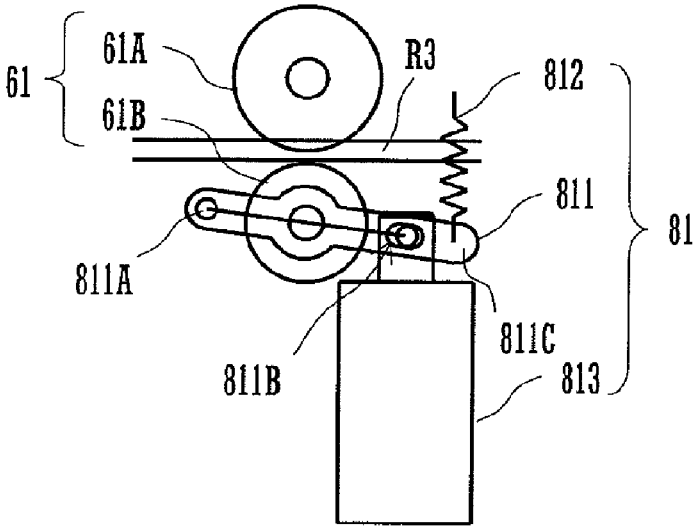

As shown in FIG. 3A, in order that only the biasing force of the tension spring 812 may act on the arm 811 at the time of stop of an electric power supply to the solenoid 813, the driven roller 61B is in contact with the driving roller 61A. The pair of forward and backward rotating rollers 61 is kept contacted. As shown in FIG. 3B, in order that the force that is greater than the biasing force of the tension spring 812 and pulls to a side opposed to the driving roller 61A acts on the arm 811 at the time of supplying the electric power to the solenoid 813, the driven roller 61B is separated from the driving roller 61A. The pair of forward and backward rotating rollers 61 is kept separated.

As described so far, the control portion 200 can keep the pair of forward and backward rotating rollers 61 separated or contacted only by switching the electric power supply to the solenoid 813 of the separation portion 81.

Figure 4:
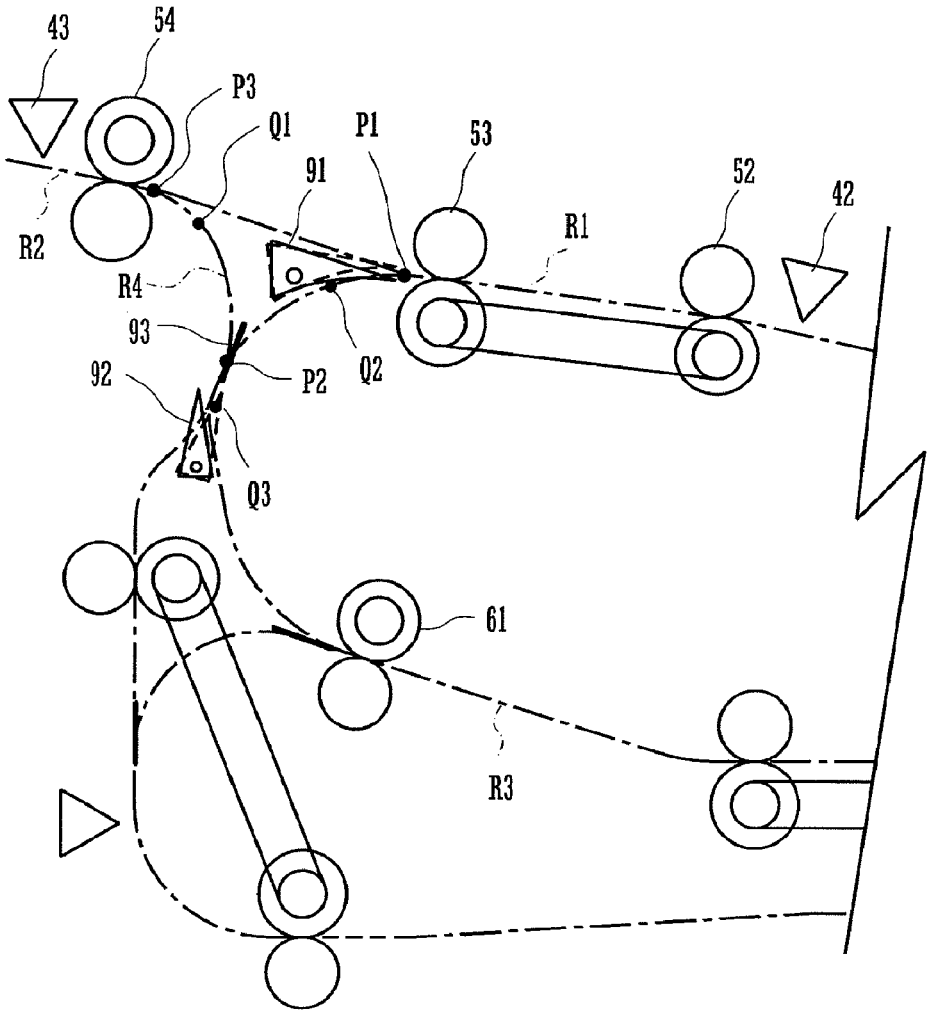
FIG. 4 is a schematic view of the vicinity of a branch portion in the sheet feed path.

In addition, as shown in FIG. 4, a gate 91 is disposed near the branch point P1. The gate 91 is connected to a solenoid 911 (see FIG. 7), turns into a position illustrated by a dashed line at the time of supplying electric power to the solenoid 911, and connects the sheet guide path R1 and the switch back path R3. The gate 91 also turns into a position illustrated by a solid line at the time of stopping supplying electric power to the solenoid 911, and connects the sheet guide path R1 and the first sheet output path R2.

Figure 5B:
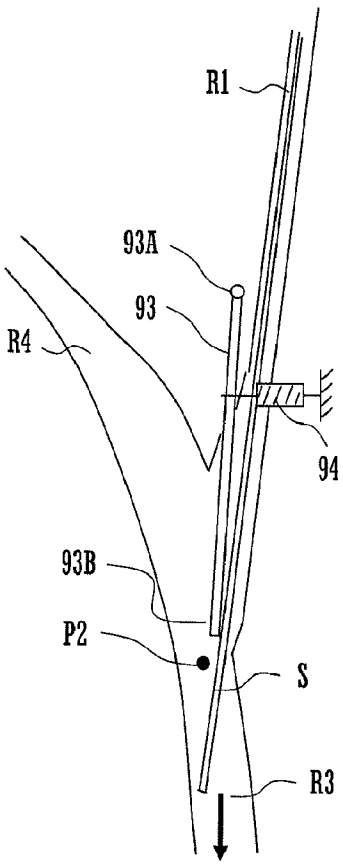
FIG. 5A and FIG. 5B are views illustrating a feed-in state of a sheet to a switch back path.
Figure 5A:
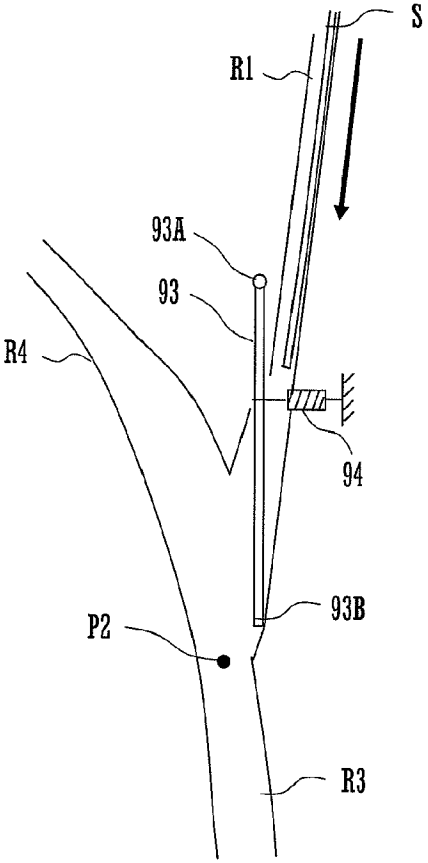
Figure 6:
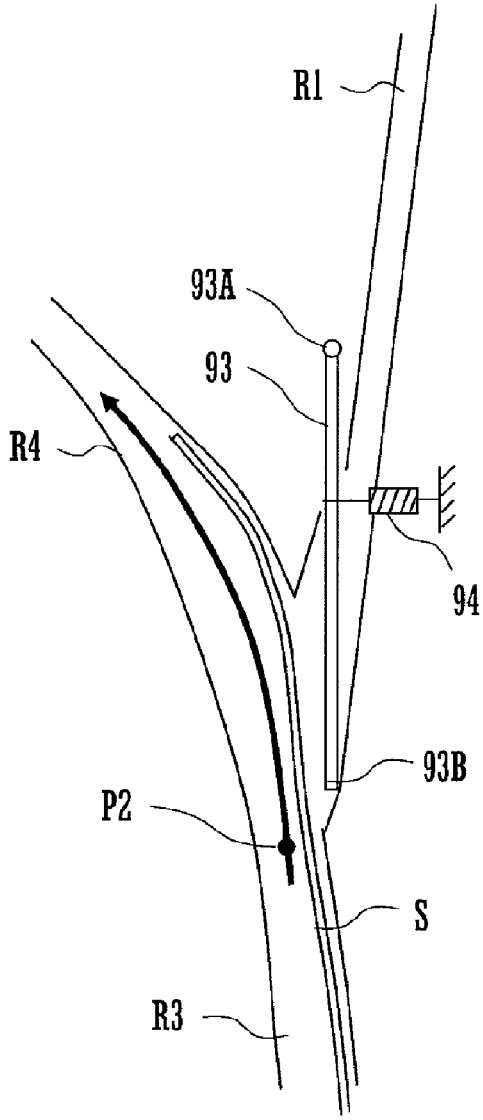
FIG. 6 is a view illustrating a feed-out state of a sheet out of the switch back path.

An auxiliary member 93 is disposed at the branch point P2. As shown in FIG. 5A, the auxiliary member 93 has a flat plate shape, and is mounted to the substrate by using a first end 93A opposite to the branch point P2 as a pivot shaft. The auxiliary member 93 is disposed so that a second end 93B capable of freely pivoting may close the sheet guide path R1 by the biasing force of the tension spring 94. As shown in FIG. 5B, a sheet S being fed from the sheet guide path R1 is fed to the switch back path R3 after the sheet guide path R1 is opened by separating the second end 93B of the auxiliary member 93 from the sheet guide path R1 by a feeding force for feeding the sheet S. Subsequently, as shown in FIG. 6, since the sheet guide path R1 is closed, the sheet S fed from the switch back path R3 is fed to the second sheet output path R4.

As shown in FIG. 4, a gate 92 is disposed near the branch point P2 side of the switch back path R3. The gate 92 is connected to a solenoid 921 (see FIG. 7), turns into a position illustrated by a dashed line at the time of supplying electric power to the solenoid 921, and closes the switch back path R3. The gate 92 also turns into a position illustrated by a solid line at the time of stopping supplying electric power to the solenoid 912, and opens the switch back path R3.

Figure 7:
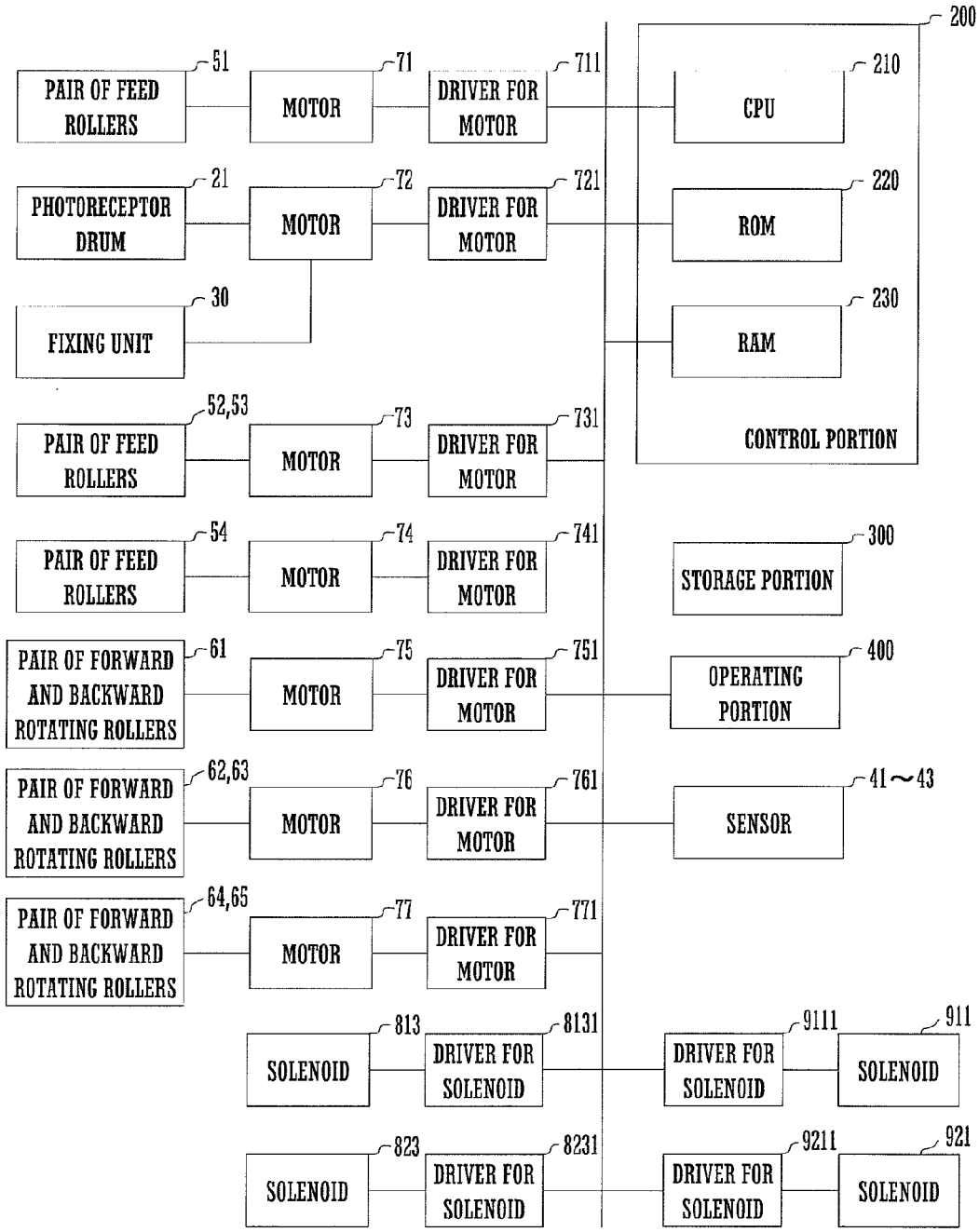
FIG. 7 is a block diagram illustrating a part of a functional configuration of the image forming apparatus.

As shown in FIG. 7, the control portion 200 includes a CPU 210, a ROM 220, and a RAM 230, and is connected to a storage portion 300, an operating portion 400, sensors 41 to 43, drivers 711, 721, 731, 741, 751, 761, and 771 for motors, and drivers 8131, 8231, 9111, and 9211 for solenoids.

The CPU 210 reads the control program recorded on the ROM 220, utilizes the RAM 230 as a working area, and executes the control program.

The operating portion 400 receives various setting items for printing requirements, a print start instruction, and the like.

The storage portion 300 stores a feed interval table 301 shown in FIG. 8A as an example, a feed table 302 shown in FIG. 8B as an example, and a feed table 303 shown in FIG. 8C as an example.

The feed interval table 301 stores feed interval time when the sheet S is fed from the sheet feed portion 120 for each sheet size. By referring to the feed interval table 301, the control portion 200 can feed the sheet S to the sheet feed path R from the sheet feed portion 120 at a certain time interval (in other words, at a certain sheet interval). As a sheet size becomes larger (as the length L of the feed direction of the sheet S becomes longer), the feed interval time when the sheet S is fed from the sheet feed portion 120 is set to be greater.

The feed interval table 301 shows different feed interval time set for each sheet output mode (a face-up mode and a face-down mode). In the face-up mode, the sheet S is output from the sheet guide path R1 to the first sheet output path R2. In the face-down mode, the sheet S after being reversed is output from the first sheet guide path R1 to the first sheet output path R2 through the switch back path R3 and the second sheet output path R4.

The feed table 302 stores passing time from a time when the sensor 43 detects the leading edge of the sheet S to a time when the rear end of the sheet S passes the pair of forward and backward rotating rollers in a state where the rollers are contacted for each sheet size.

The feed table 303 stores passing time from a time when the sensor 43 detects the leading edge of the sheet S to a time when the rear end of the sheet S passes a position Q1 (on the second sheet output path R4 and near the downstream side of the pair of feed rollers 54) for each sheet size.

Timers Tg, Tu, Tw, Tx, and Ty are allocated to a predetermined area of the RAM 230, and various timer values are set to the timers. The control portion 200 subtracts a timer value at the same time as start of the timers Tg, Tu, Tw, Tx, and Ty until the timers are up (the timer value becomes 0).

The timer Tg measures time from a time when the sheet S is fed to a time when the succeeding sheet S is fed. To the timer Tg, the feed interval time stored in the feed table 301 is set as a timer value.

The timer Tu measures time from a time when the sensor 42 detects the rear edge of the sheet S to a time when the rear end of the sheet S passes a position Q2 (on the sheet guide path P1 and near the downstream side of the pair of feed rollers 53). To the timer Tu, a first time obtained by dividing a distance from a position of the sensor 42 to a position Q2 by a feed speed (the second feed speed) of the sheet S is set as a timer value.

The timer Tw measures time from a time when the sensor 42 detects the rear edge of the sheet S to a time when the rear end of the sheet S passes a position Q3 (near the pair of forward and backward rotating rollers 61 side of the auxiliary member 93). To the timer Tw, a second time calculated by dividing a distance from a position of the sensor 42 to a position Q3 by a feed speed (the second feed speed) of the sheet S is set as a timer value.

The timer Tx measures time from a time when the sensor 43 detects the leading edge of the sheet S to a time when the rear edge of the sheet S passes the pair of forward and backward rotating rollers which contact the switch back path R3. To the timer Tx, the passing time stored in the feed table 302 is set as a timer value. The timer Ty measures time from a time when the sensor 43 detects the leading edge of the sheet S to a time when the rear edge of the sheet S passes the position Q1. To the timer Ty, the passing time stored in the feed table 303 is set as a timer value.

The control portion 200 outputs driving data to the drivers 711, 721, 731, 741, 751, 761, and 771 for motors, and outputs switching data to the drivers 8131, 8231, 9111, and 9211 for solenoids at a predetermined timing such as an instruction signal from the operating portion 400, a detection signal from the sensors 41 to 43, and a timing when the timers Tu, Tw, Tx, and Ty are up.

The drivers 711 and 721 for motors selectively supply electric power to the motors 71 and 72 which can freely rotate at the first speed, respectively, based on the driving data. The drivers 731 and 741 for motors selectively switch speeds and supply electric power to the motors 73 and 74 which can freely rotate at the first speed or the second speed, respectively, based on the driving data. The drivers 751, 761, and 771 for motors selectively switch speeds and rotating directions and supply electric power to the motors 75 to 77 which can freely rotate forwards and backwards at the first speed or second speed, respectively, based on the driving data.

The drivers 8131 to 8231 for solenoids selectively supply electric power to the solenoids 813 and 823 of the separation portions 81 and 82, respectively, based on the switching data. The drivers 9111 to 9211 for solenoids selectively supply electric power to the solenoids 911 and 921 of the gates 91 and 92, respectively, based on the switching data.

Subsequently, the sheet output processing of the control portion 200 during image formation will be described.

The control portion 200 receives a sheet output mode, a size of a sheet to be printed, and the printing number of sheets from a personal computer (not shown) on a network. The control portion 200 performs the following processing according to the sheet output mode.

To begin with, a flow of the processing of the control portion 200 in the face-up mode will be described.

The control portion 200 performs pre-processing in the face-up mode. In the pre-processing, the control portion 200 rotates the pairs of feed rollers 51 to 54 at the first speed through the motors 71 to 74. The control portion 200 stops the electric power supply to the solenoid 911 of the gate 91, and switches the gate 91 so that the sheet S can be fed from the sheet guide path R1 to the first sheet output path R2. The control portion 200 also stops the electric power supply to the solenoid 921 and the motors 75 to 77 of the gate 92.

After the pre-processing is completed, the control portion 200 acquires feed interval time (for example, tgu1) according to the size of the sheet S to feed with reference to the feed interval table 301. The control portion 200 sets the acquired feed interval time to the timer Tg, and feeds the sheet S from the sheet feed portion 120 when the timer Tg is up. The control portion 200 sets feed interval time to the timer Tg every time when the timer Tg is up until completing feeding the sheet S for the printing number of sheets, and feeds the sheet S from the sheet feed portion 120. Thereby, the sheet S is fed at a predetermined sheet interval from the sheet guide path R1 to the first sheet output path R2.

Next, a flow of the processing of the control portion 200 in the face-down mode will be described. Hereinafter, feeding a sheet in a direction in which a short side direction of the sheet is parallel to the feed direction of the sheet will be referred to as "horizontal feed", and feeding a sheet in a direction in which a long side direction of the sheet is parallel to the feed direction of the sheet will be referred to as "vertical feed". The feed direction in association with a sheet size is expressed as "A4 horizontal feed", for example. In addition, a length of the short side of the sheet will be referred to as "horizontal length" and a length of the long side of the sheet will be referred to as "vertical length". The length in association with a sheet size is expressed as "A4 vertical length", for example. The following describes a case where a sheet S is fed by the A4 horizontal feed as an example.

Figure 9:
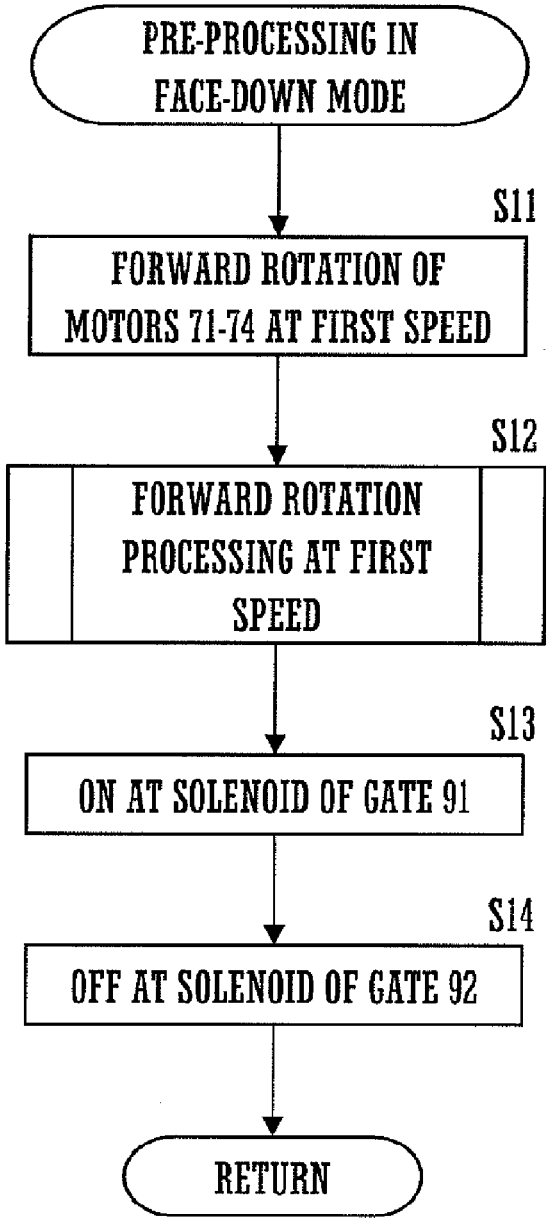
FIG. 9 is a flow chart showing a procedure at the time of performing pre-processing in a face down mode.

The control portion 200 performs pre-processing of the face-down mode, as shown in FIG. 9. In the pre-processing, the control portion 200 rotates the photoreceptor drum 21, the fixing unit 30, and the pairs of feed rollers 51 to 54 at the first speed through the motors 71 to 74 (S11). The control portion 200 performs forward rotation processing at the first speed (S12).

Figure 10:
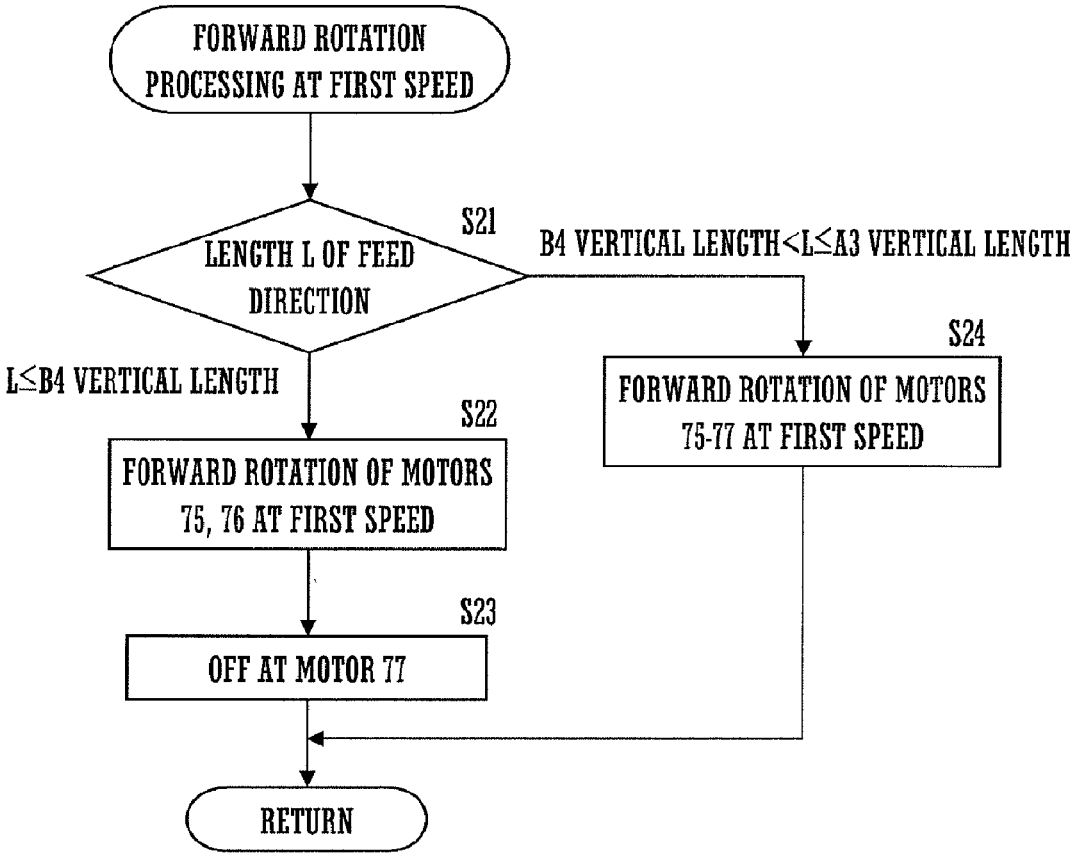
FIG. 10 is a flow chart showing a procedure at the time of performing forward rotation processing of a first speed.

In the forward rotation processing, as shown in FIG. 10, the control portion 200 forward rotates the pair of forward and backward rotating rollers 61 to 63 at the first speed through the motors 75 and 76 (S22) in the case where a length L (an A4 horizontal length) of the feed direction of the sheet S is shorter than a B4 vertical length (S21). The control portion 200 supplies no electric power to the motor 77 (S23).

In a case where a length L of the feed direction of the sheet S is longer than the B4 vertical length, the control portion 200 forward rotates the pair of forward and backward rotating rollers 61 to 65 at the first speed through the motors 75 to 77 (S24).

After the forward rotation processing at the first speed is completed, the control portion 200 supplies electric power to the solenoid 911 of the gate 91, and switches the gate 91 so that the sheet may be fed from the sheet guide path R1 to the switch back path R3 (S13). The control portion 200 stops supplying electric power to the solenoid 911 of the gate 91, and switches the gate 92 so as to open the switch back path R3 (S14). After the pre-processing is completed, the control portion 200 acquires feed interval time (tgd1 in the case of the A4 horizontal feed) according to the size of the sheet S to feed with reference to the feed interval table 301. The control portion 200 sets the acquired feed interval time to the timer Tg, and feeds the sheet S from the sheet feed portion 120 when the timer Tg is up. The control portion 200 sets feed interval time to the timer Tg every time when the timer Tg is up until completing feeding the sheet S for the printing number of sheets, and feeds the sheet S from the sheet feed portion 120. Thereby, the sheet is fed to the sheet guide path R1 at a predetermined sheet interval.

The control portion 200 performs sheet reversal processing when the sheet S fed from the sheet feed portion 120 passes the fixing unit 30.

Figure 11:
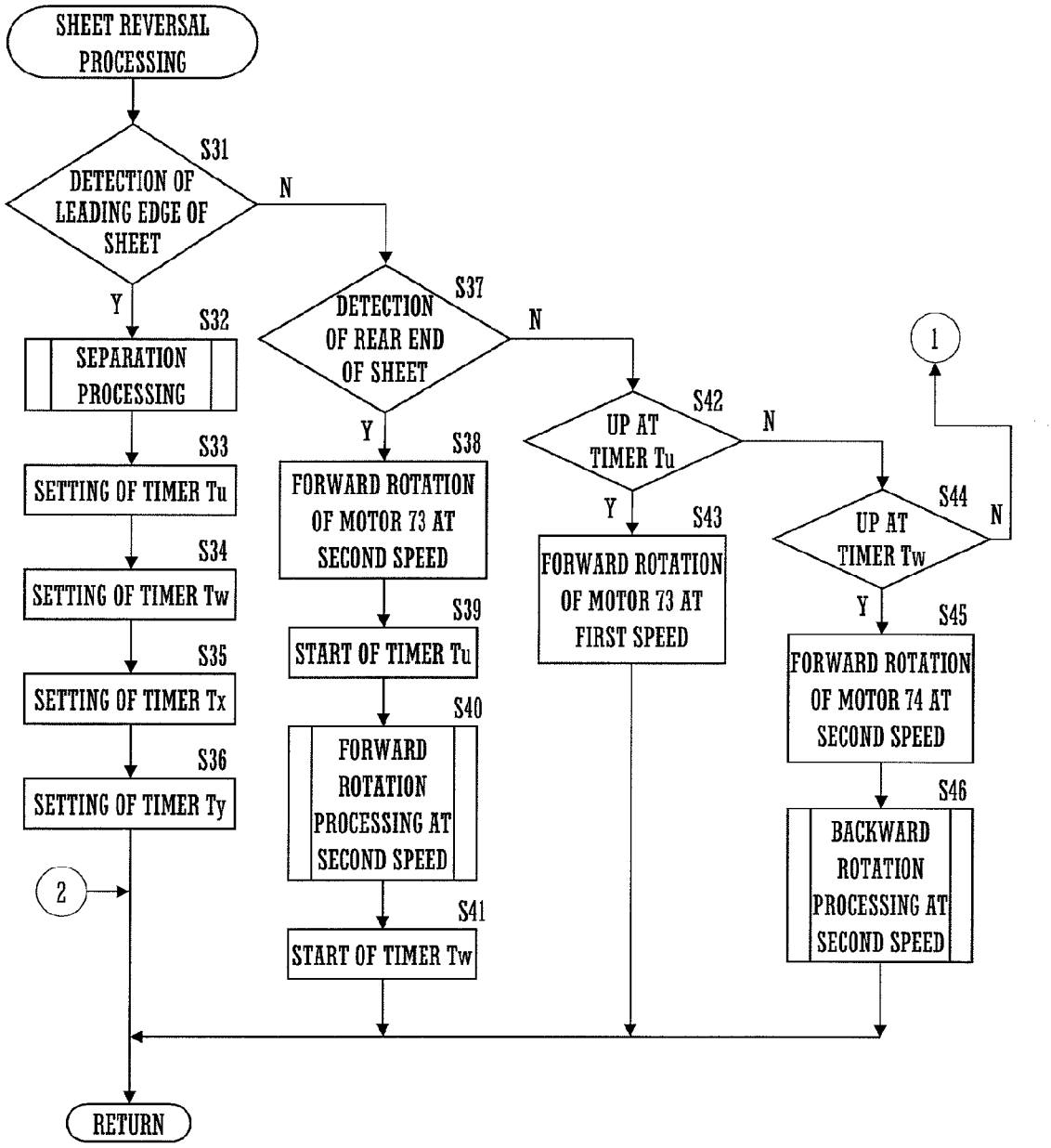
FIG. 11 is a flow chart showing a procedure at the time of performing sheet reversal processing.

As shown in FIG. 11, when the sensor 42 detects the leading edge of the sheet S (Y in S31), the control portion 200 performs separation processing (S32).

Figure 13:
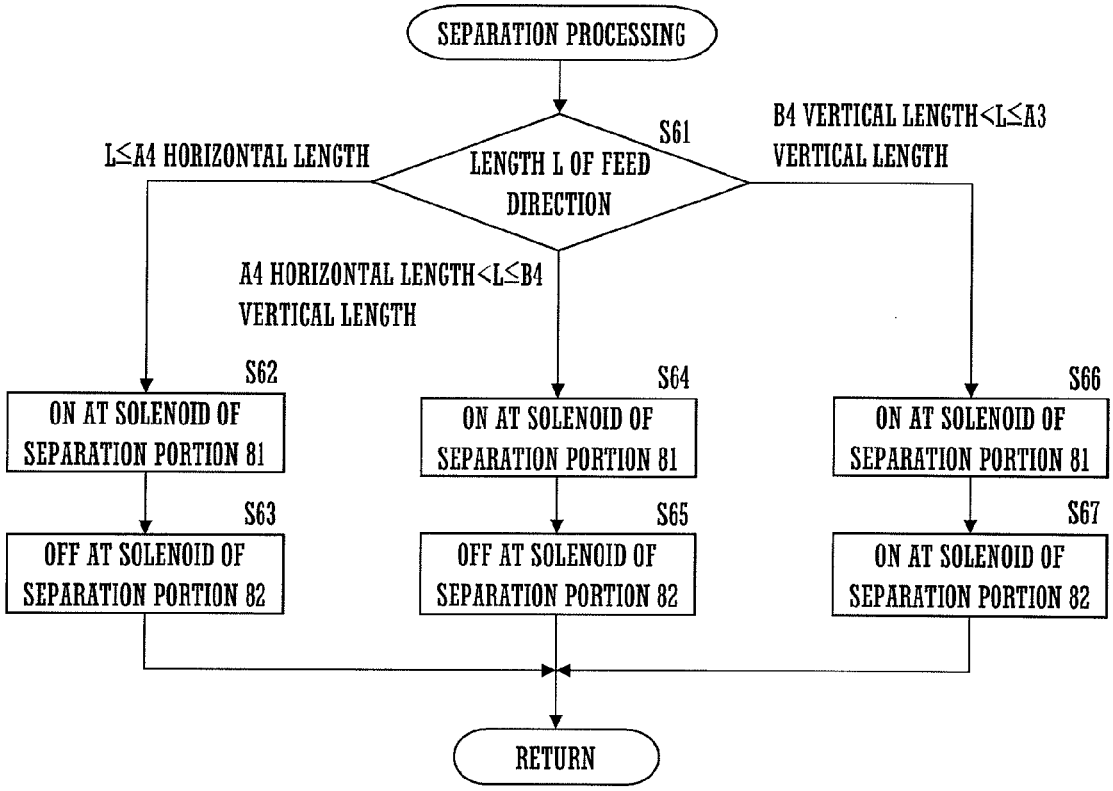
FIG. 13 a flow chart showing a procedure at the time of performing separation processing.

In the separation processing, as shown in FIG. 13, the control portion 200, when the length L (the A4 horizontal length) of the feed direction of the sheet S is shorter than the A4 horizontal length (corresponding to a first predetermined length of the present invention) (S61), supplies no electric power supply to the solenoids 813 and 823 of the separation portions 81 and 82 (S62, S63). In other words, the control portion 200 does not separate the pair of forward and backward rotating rollers 61 and 62.

In a case where the length L of the feed direction of the sheet S is longer than the A4 horizontal length, and is shorter than the B4 vertical length (corresponding to a second predetermined length of the present invention), the control portion 200 supplies electric power to the solenoid 813 of the separation portion 81 (S64), and supplies no electric power to the solenoid 823 of the separation portion 82 (S65). In other words, the control portion 200 separates the pair of forward and backward rotating rollers 61 from each other, and does not separate the pair of forward and backward rotating rollers 62. In addition, in a case where the length L of the feed direction of sheet S is longer than the B4 vertical length, the control portion 200 supplies electric power to the solenoids 813 and 823 of the separation portions 81 and 82 (S66, S67). In other words, the control portion 200 separates the pairs of forward and backward rotating rollers 61 and 62 from each other.

The control portion 200 sets the first time to the timer Tu (S33), and sets the second time to the timer Tw (S34). The control portion 200, referring to the feed table 302, sets passing time (tx1 in a case of the A4 horizontal feed) according to the size of the sheet S to be fed to the timer Tx (S35), and, referring to the feed table 303, sets passing time (ty1 in a case of the A4 horizontal feed) to the timer Ty (S36).

Figure 16A:
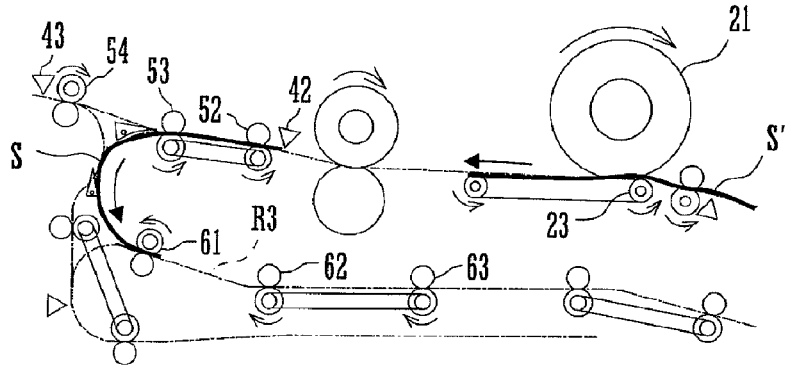
FIGS. 16A to 16C are transition views of a first half period at the time of successively performing double-sided image formation processing to a plurality of small-sized sheets.

The control portion 200, as shown in FIG. 16A, when the sensor 42 detects the rear end of the sheet S, that is to say, detects that the sheet has passed the fixing unit 30 (N in S31 and Y in S37), rotates the pairs of feed rollers 52 and 53 at the second speed through the motor 73 (see FIG. 7) (S38), and starts the timer Tu (S39). The control portion 200 performs the forward rotation processing at the second speed (S40), and starts the timer Tw (S41).

Figure 14:
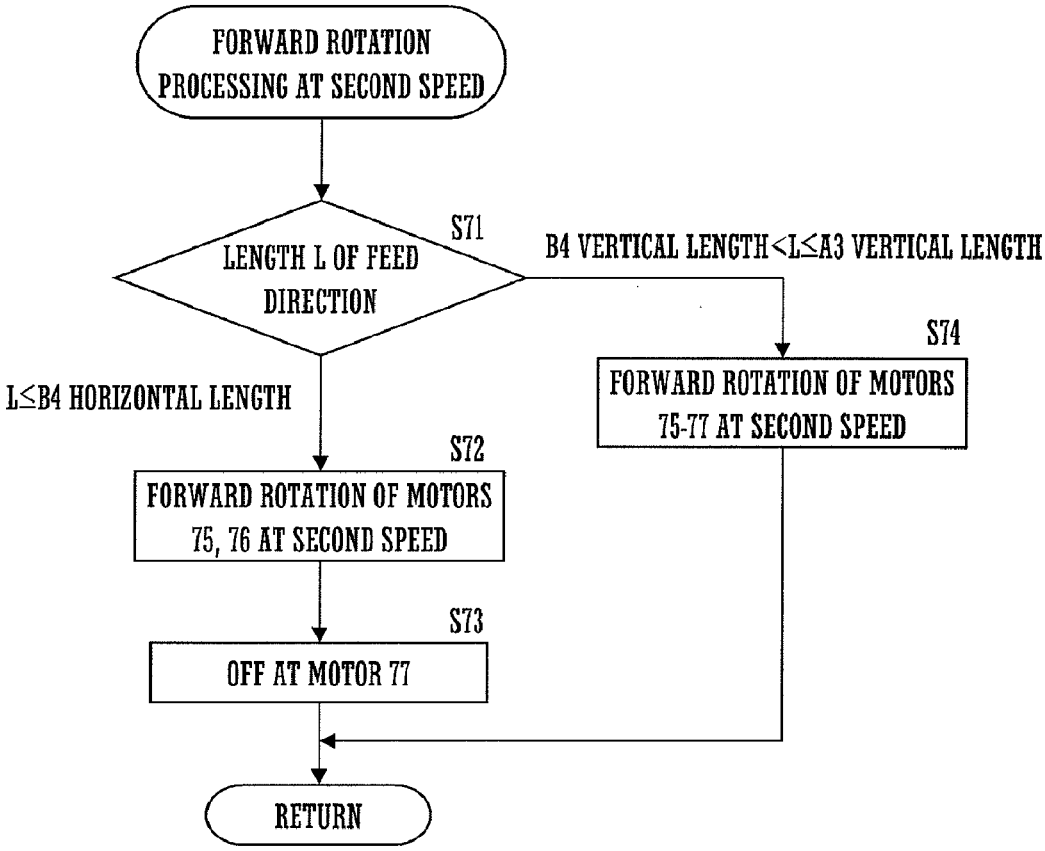
FIG. 14 is a flow chart showing a procedure at the time of performing the forward rotation processing of a second speed.

In the forward rotation processing at the second speed, as shown in FIG. 14, the control portion 200, when the length L (the A4 horizontal length) of the feed direction of the sheet S is shorter than the B4 vertical length (S71), forward rotates the pairs of forward and backward rotating rollers 61 to 63 through the motors 75 and 76 at the second speed (S72). The control portion 200 supplies no electric power to the motor 77 (S73).

In a case that the length L of the feed direction of the sheet S is longer than the B4 vertical length, the control portion 200 forward rotates the pairs of forward and backward rotating rollers 61 to 65 at the second speed through the motors 75 to 77 (S74).

As shown in FIG. 16A, at the point of time when the sensor 42 detects the rear end of the sheet S, the image formation processing to the sheet S is completed, so that the control portion 200 switches the feed speed from the first feed speed to the second feed speed to feed the sheet S. At this time, a sheet S to be fed (hereinafter will be referred to as "a succeeding sheet S'") next to the sheet S is fed between the photoreceptor drum 21 and the transfer device 23 at the first feed speed, and is subjected to image formation processing.

Figure 16B:
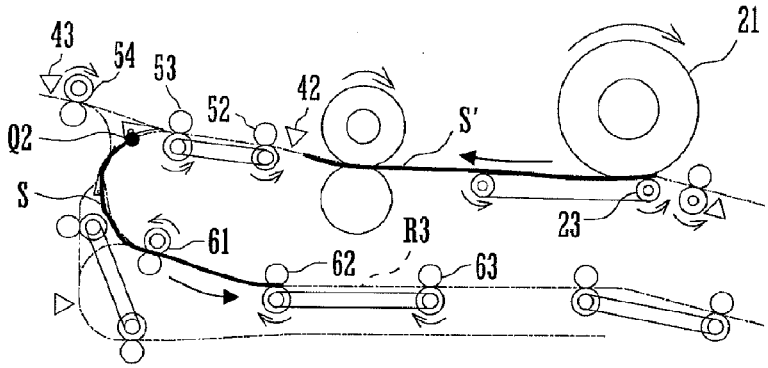

The control portion 200, as shown in FIG. 16B, when the timer Tu is up and the rear end of the sheet S reaches the position Q2 (N in S31, N in S37, and Y in S42), rotates the pairs of feed rollers 52 and 53 through the motor 73 at the first speed (S43).

As shown in FIG. 16B, at the point of time when the rear end of the sheet S reaches the position Q2, the control portion 200 rotates the pairs of feed rollers 52 and 53 at the first speed in preparation for feeding a succeeding sheet S' since the rear end of the sheet S has passed the pair of feed rollers 53. The sheet S is fed at the second feed speed, and the succeeding sheet S' is fed at the first feed speed.

Figure 16C:
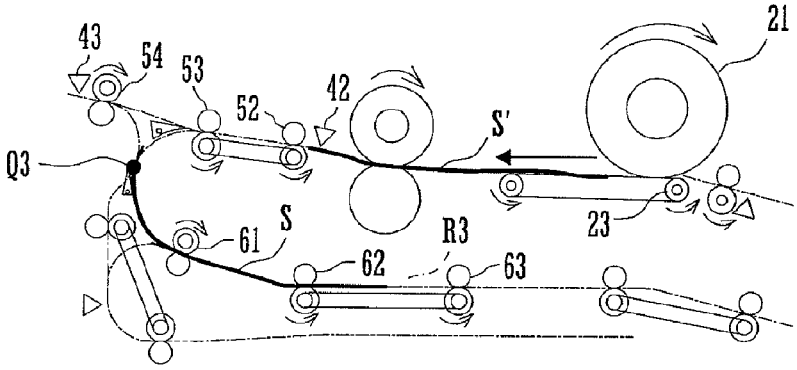

The control portion 200, as shown in FIG. 16C, when the timer Tw is up, in other words, the rear end of the sheet S reaches the position Q3 (N in S31, N in S37, N in S42, and Y in S44), rotates the pair of feed rollers 54 through the motor 74 at the second speed (S45). The control portion 200 performs backward rotation processing at the second speed (S46).

Figure 15:
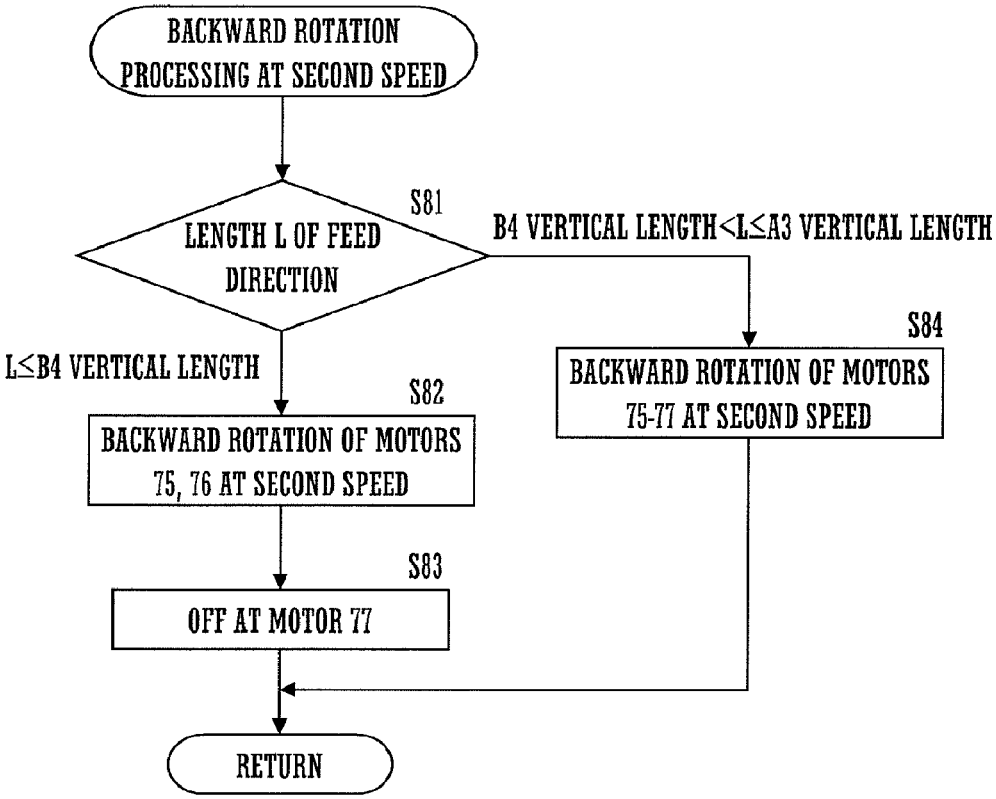
FIG. 15 is a flow chart showing a procedure at the time of performing backward rotation processing of the second speed.

In the backward rotation processing at the second speed, as shown in FIG. 15, when the length L (the A4 horizontal length) of the feed direction of the sheet S is shorter than the B4 vertical length (S81), the control portion 200 backward rotates the pairs of forward and backward rotating rollers 61 to 63 through the motors 75 and 76 at the second speed (S82). The control portion 200 supplies no electric power to the motor 77 (S83).

In a case that the length L of the feed direction of the sheet S is longer than the B4 vertical length, the control portion 200 backward rotates the pairs of forward and backward rotating rollers 61 to 65 at the second speed through the motors 75 to 77 (S84).

As shown in FIG. 16C, at the point of time when the rear end of the sheet S reaches the position Q3, the sheet S is positioned on the switch back path R3, so that the control portion 200 backward rotates the pairs of forward and backward rotating rollers 61 to 63 at the second speed, and starts feeding the sheet S to the outside of the switch back path R3 at the second feed speed. At this time, the leading edge of the succeeding sheet S' being fed at the first feed speed is detected by the sensor 42. For this reason, the control portion 200 also performs the sheet reversal processing to the succeeding sheet S'.

It is to be noted that, when the rear end of sheet S is in the position Q3, the leading edge of the sheet S is positioned between the pair of forward and backward rotating rollers 62 and the pair of forward and backward rotating rollers 63 in the case of the A4 horizontal feed, and is between the pair of forward and backward rotating rollers 63 and the pair of forward and backward rotating rollers 64 in the case of B4 vertical feed. Additionally, in the case of an A3 horizontal feed, the leading edge of the sheet S is between the pair of forward and backward rotating rollers 64 and the pair of forward and backward rotating rollers 65. Therefore, in a case where a sheet has a length shorter than the B4 vertical length, the pairs of forward and backward rotating rollers 64 and 65 are unnecessary to be rotated.

Figure 12:
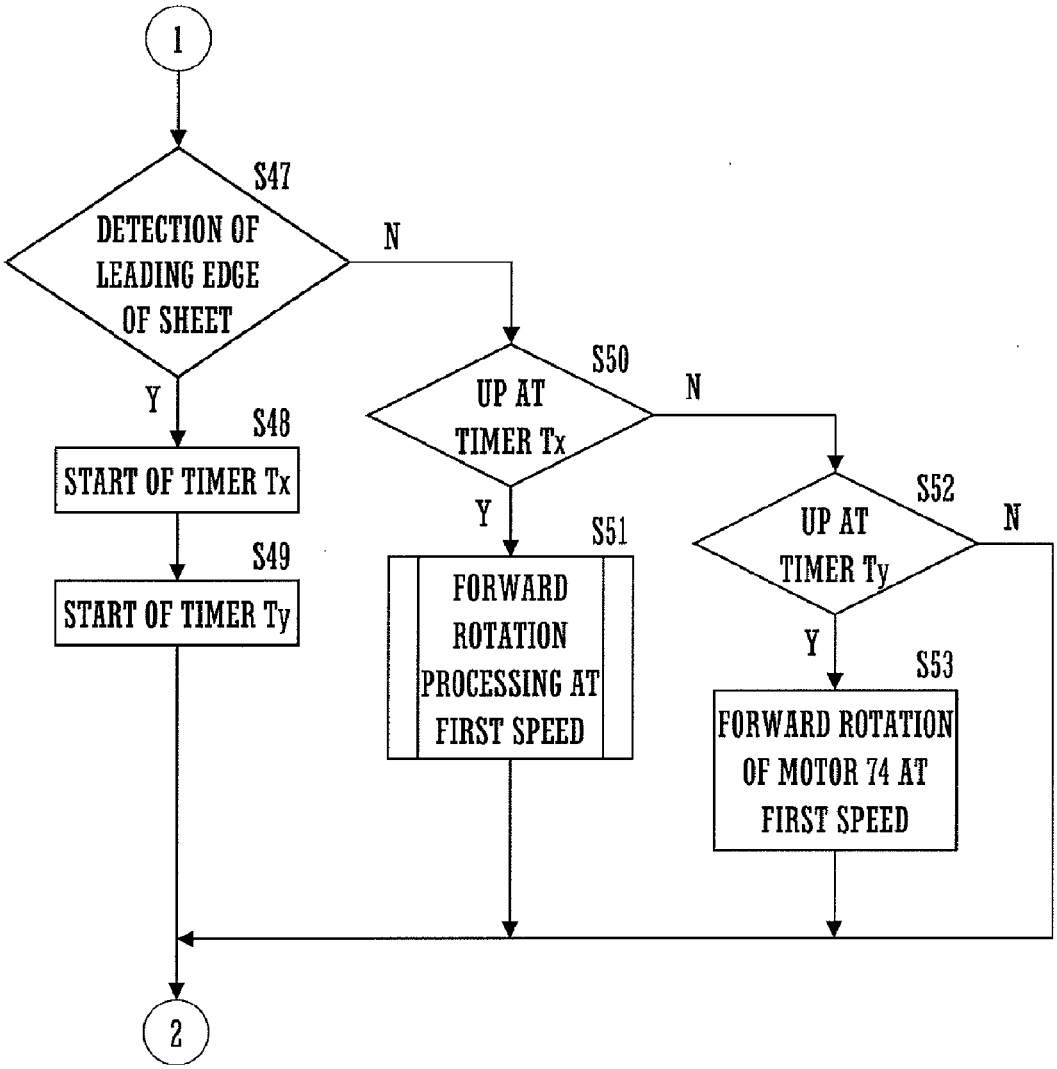
FIG. 12 is also a flow chart showing a procedure at the time of performing the sheet reversal processing.
Figure 17A:
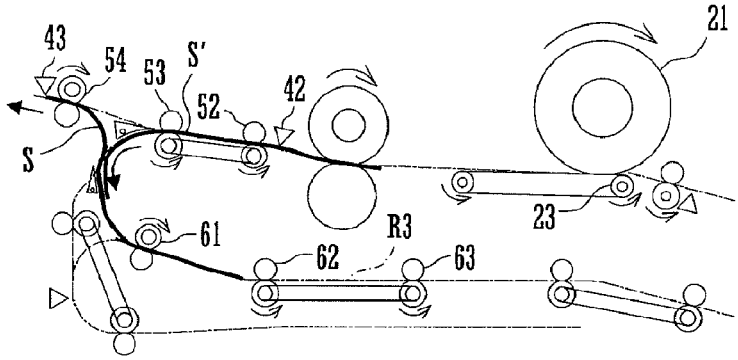
FIGS. 17A to 17C are transition views of a second half period at the time of successively performing double-sided image formation processing to a plurality of small-sized sheets.

The control portion 200, as shown in FIGS. 12 and 17A, when the sensor 43 detects the leading edge of the sheet S (N in S31, N in S37, N in S42, N in S44, and Y in S47), starts the timer Tx and the timer Ty (S48, S49).

As shown in FIG. 17A, at the point of time when the sensor 43 detects the leading edge of the sheet S, the sheet S is reversed in the switch back path R3, and the leading edge thereof is nipped by the pair of feed rollers 54. The sheet S is fed by the pair of feed rollers 54 and the pair of forward and backward rotating rollers 61 at the second feed speed. The leading edge of the succeeding sheet S' is guided into the switch back path R3 at the first feed speed by the pairs of feed rollers 52 and 53.

Figure 17B:
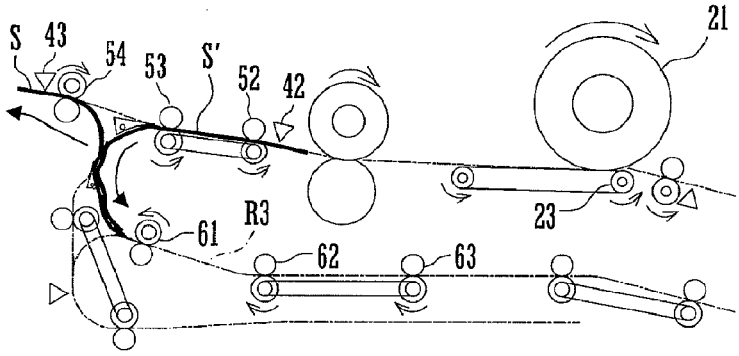

The control portion 200, as shown in FIG. 17B, when the timer Tx is up and the rear end of the sheet S passes the pairs of forward and backward rotating rollers 61 (N in S31, N in S37, N in S42, N in S44, N in S47, and Y in S50), performs the forward rotation processing at the first speed (S51).

As shown in FIG. 17B, at the point of time when the rear end of the sheet S passes the pairs of forward and backward rotating rollers 61, the sheet S is not nipped by the pairs of forward and backward rotating rollers 61, and the control portion 200 outputs the sheet S to the first sheet output path R2 at the second feed speed by the pair of feed rollers 54. At this time, the succeeding sheet S', the leading edge thereof being not nipped by the pair of forward and backward rotating rollers 61, is fed to the switch back path R3 at the first feed speed by the pairs of feed rollers 52 and 53.

Figure 17C:
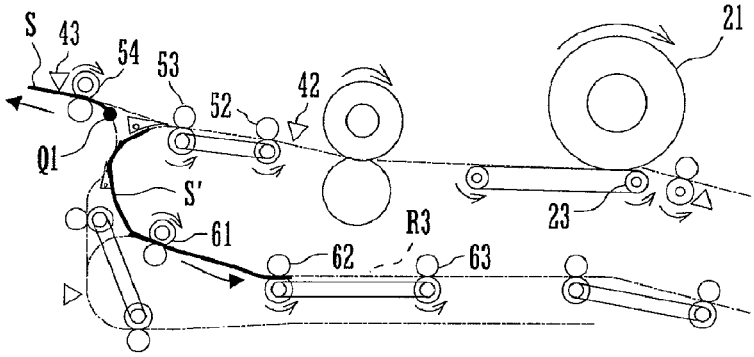

The control portion 200, as shown in FIG. 17C, when the timer Ty is up and the rear end of the sheet S reaches the position Q1 (N in S31, N in S37, N in S42, N in S44, N in S47, N in S50, and Y in S52), rotates the pair of feed rollers 54 through the motor 74 at the first speed (S53).

As shown in FIG. 17C, at the point of time when the rear end of the sheet S reaches the position Q1, the sheet S passes the switch back path R3, so that the control portion 200 switches the feed speed from the second feed speed to the first feed speed to feed the sheet S. At this time, the succeeding sheet S', the leading edge thereof being nipped by the pair of forward and backward rotating rollers 62, is fed to the switch back path R3 at the second feed speed by the pairs of forward and backward rotating rollers 62.

As stated above, at the time of feeding a sheet S of the A4 horizontal length, the control portion 200 keeps the pairs of forward and backward rotating rollers 61 and 62 contacted by the separation portions 81 and 82, and performs feed control which allows a sheet S output from the switch back path R3 and a succeeding sheet S' guided into the switch back path R3 to pass each other in the switch back path.

Thereby, the control portion 200 can shorten the feed time of sheets as compared with the case where sheets are fed without making the sheets pass each other. In addition, the control portion 200 can further shorten the feed time of sheets by changing the feed speed of the sheet in the switch back path R3 to the second feed speed faster than the first feed speed.

Then, a flow of the processing of the control portion 200 in the face-down mode will be described by taking as an example the case of successively feeding a sheet S of the A3 vertical length. The following describes only the difference with a case of feeding a sheet S of the A4 horizontal length.

In a case of feeding a sheet of the A3 vertical length, the control portion 200 supplies electric power to the motors 75, 76, and 77 in the forward rotation processing of the first speed, the forward rotation processing of the second speed, and the backward processing of the second speed. The control portion 200 rotates the motor 77 at the same speed and in the same direction as the motors 75 and 76.

The control portion 200, referring to the various tables 301 to 303 stored in the storage portion 300, sets a feed interval (tgd3 in the case of the A3 vertical feed), the timer Tx (tx3 in the case of the A3 vertical feed), and the timer Ty (ty3 in the case of the A3 vertical feed), according to the size of the sheet S.

In the separating processing, since the length L of the feed direction of the sheet S is longer than the B4 vertical length, the control portion 200 supplies electric power to the solenoids 813 and 823 of the separation portions 81 and 82 (S66 and S67), and separates the pairs of forward and backward rotating rollers 61 and 62 from each other.

Figure 18A:
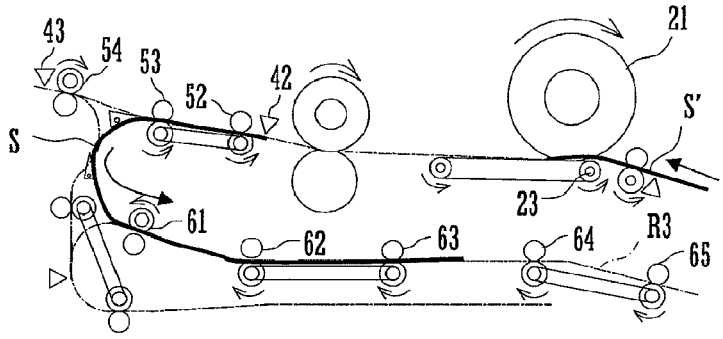
FIGS. 18A to 18C are transition views of a first half period at the time of successively performing double-sided image formation processing to a plurality of large-sized sheets.

In the sheet reversal processing, as shown in FIG. 18A, the control portion 200 switches the feed speed from the first feed speed from the second feed speed to feed the sheet S since the image formation processing to the sheet S is completed at the point of time when the sensor 42 detects the rear end of the sheet S. At this time, the succeeding sheet S' is fed between the photoreceptor drum 21 and the transfer devices 23 at the first feed speed, and is subjected to the image formation processing.

Figure 18B:
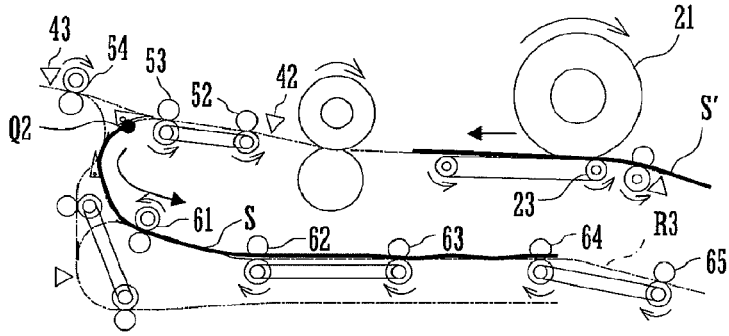

As shown in FIG. 18B, at the point of time when the rear end of the sheet S reaches the position Q2, the rear end of the sheet S has passed the pair of feed rollers 53, so that the control portion 200 rotates the pairs of feed rollers 52 and 53 at the first speed in preparation for feeding a succeeding sheet S'. The sheet S is fed at the second feed speed, and the succeeding sheet S' is fed at the first feed speed.

Figure 18C:
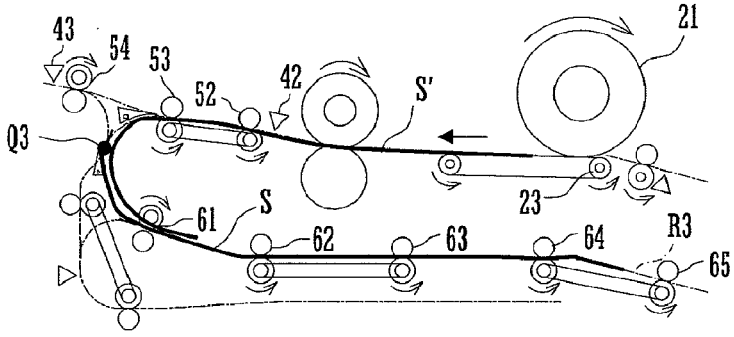

As shown in FIG. 18C, at the point of time when the rear end of the sheet S has reached the position Q3, the sheet S is positioned on the switch back path R3, so that the control portion 200 backward rotates the pairs of forward and backward rotating rollers 61 to 65 at the second speed, and starts feeding the sheet S to the outside of the switch back path R3 at the second feed speed. While the sheet S is fed to the outside of the switch back path R3, the pair of forward and backward rotating rollers 63 feeds the sheet S since the pairs of forward and backward rotating rollers 61 and 62 are kept separated. At this time, the leading edge of the succeeding sheet S' being fed at the first feed speed is detected by the sensor 42. Therefore, the control portion 200 also performs the sheet reversal processing to the succeeding sheet S'.

Figure 19A:
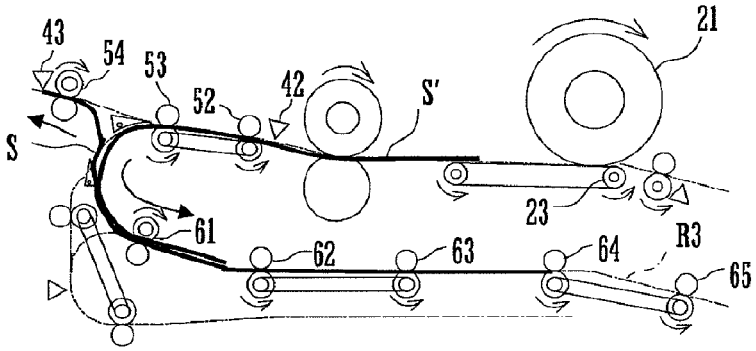
FIGS. 19A to 19C are transition views of a second half period at the time of successively performing double-sided image formation processing to a plurality of large-sized sheets.

As shown in FIG. 19A, at the point of time when the sensor 43 detects the leading edge of the sheet S, the sheet S is reversed in the switch back path R3, and the leading edge thereof is nipped by the pair of feed rollers 54. The sheet S is fed by the pair of feed rollers 54 and the pair of forward and backward rotating rollers 63 at the second feed speed. The leading edge of the succeeding sheet S' is guided into the switch back path R3 at the first feed speed by the pairs of feed rollers 52 and 53.

Figure 19B:
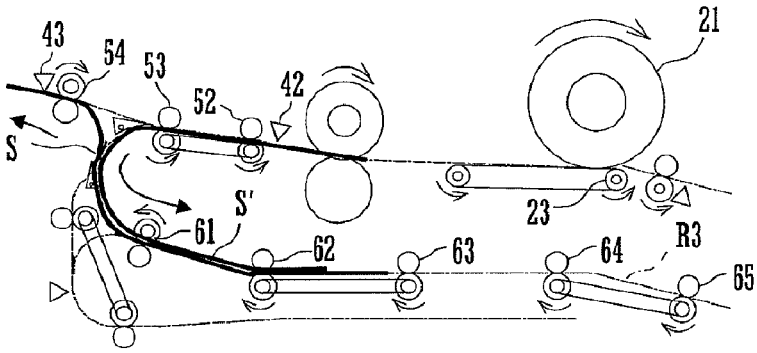

As shown in FIG. 19B, at the point of time when the rear end of the sheet S has passed the pairs of forward and backward rotating rollers 61, the rear end of the sheet S is not nipped by the pairs of forward and backward rotating rollers 63, and the control portion 200 outputs the sheet S to the first sheet output path R2 at the second feed speed by the pair of feed rollers 54. At this time, the succeeding sheet S', the leading edge thereof being not nipped by the pair of forward and backward rotating rollers 63, is fed to the switch back path R3 at the first feed speed by the pairs of feed rollers 52 and 53.

Figure 19C:
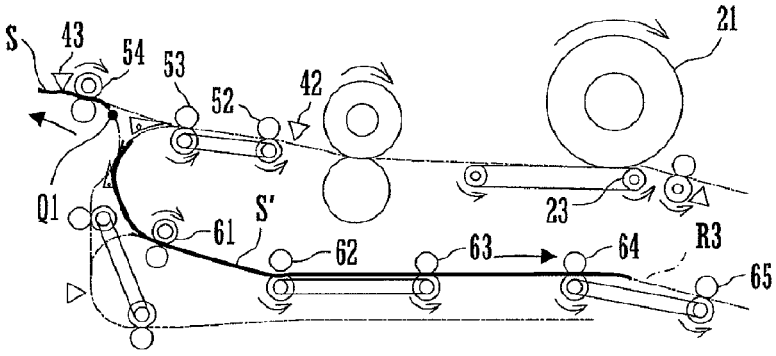

As shown in FIG. 19C, at the point of time when the rear end of the sheet S has reached the position Q1, the sheet S has come out of the switch back path R3, so that the control portion 200 switches the feed speed from the second feed speed to the first feed speed to feed the sheet S. At this time, the succeeding sheet S', the leading edge thereof being nipped by the pair of forward and backward rotating rollers 64, is fed to the switch back path R3 at the second feed speed by the pairs of forward and backward rotating rollers 64.

As stated above, at the time of feeding a sheet S of the A3 vertical length, the control portion 200 keeps the pairs of forward and backward rotating rollers 61 and 62 separated by the separation portions 81 and 82, and performs feed control which allows a sheet S output from the switch back path R3 and a succeeding sheet S' guided into the switch back path R3 to pass each other in the switch back path.

Thereby, since the control portion 200 secures a long passing distance between the sheet S and the succeeding sheet S', as compared with a case where sheets are fed without making the sheets pass each other, can shorten the feed interval of the sheet, and, as a result, can shorten the feed time of the sheet. In addition, the control portion 200 can further shorten the feed time of the sheet by changing the feed speed of the sheet in the switch back path R3 to the second feed speed faster than the first feed speed.

Figure 20:
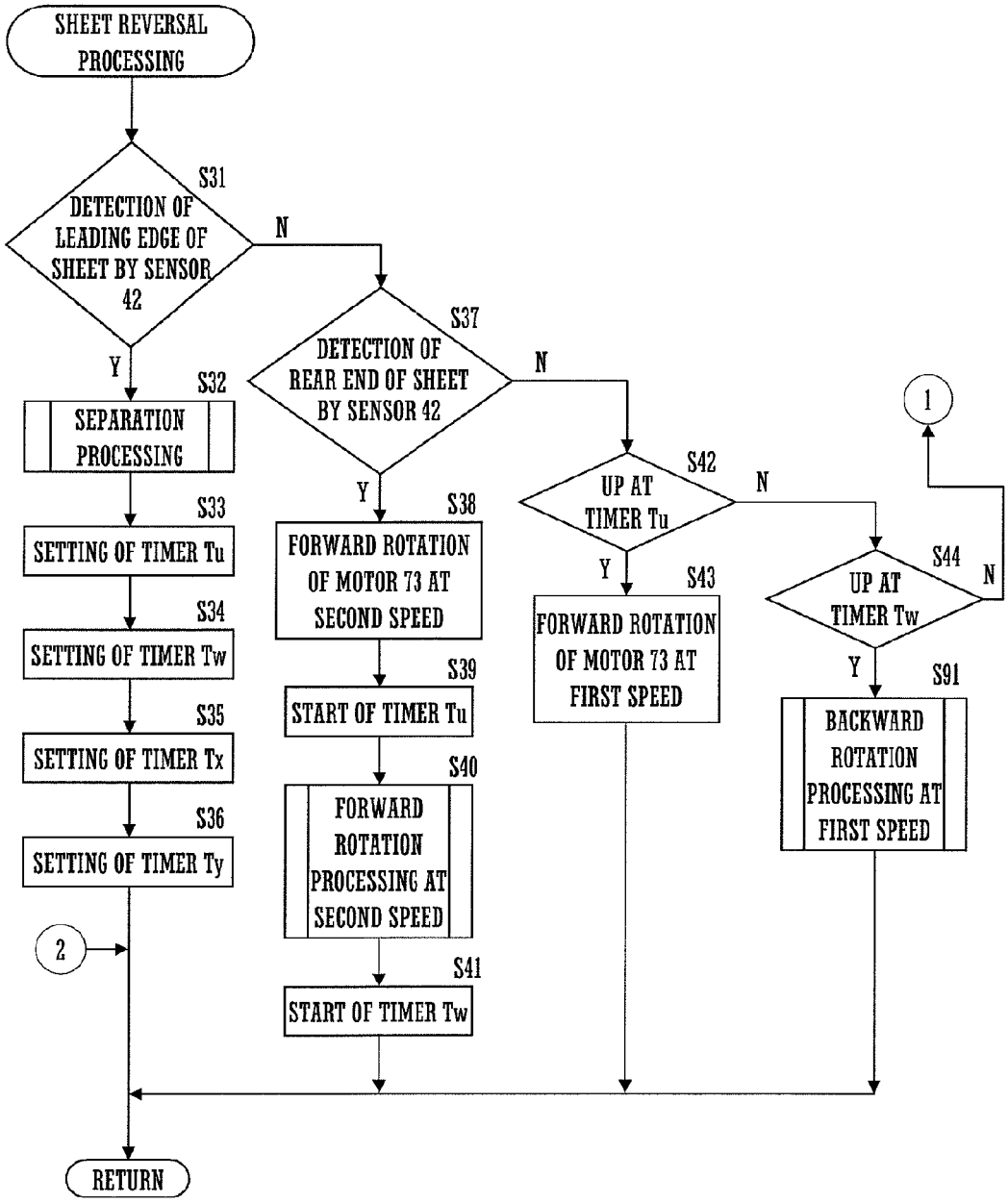
FIG. 20 is a flow chart showing a procedure at the time of performing the sheet reversal processing in a sheet feeder according to another embodiment of the present invention.
Figure 21:
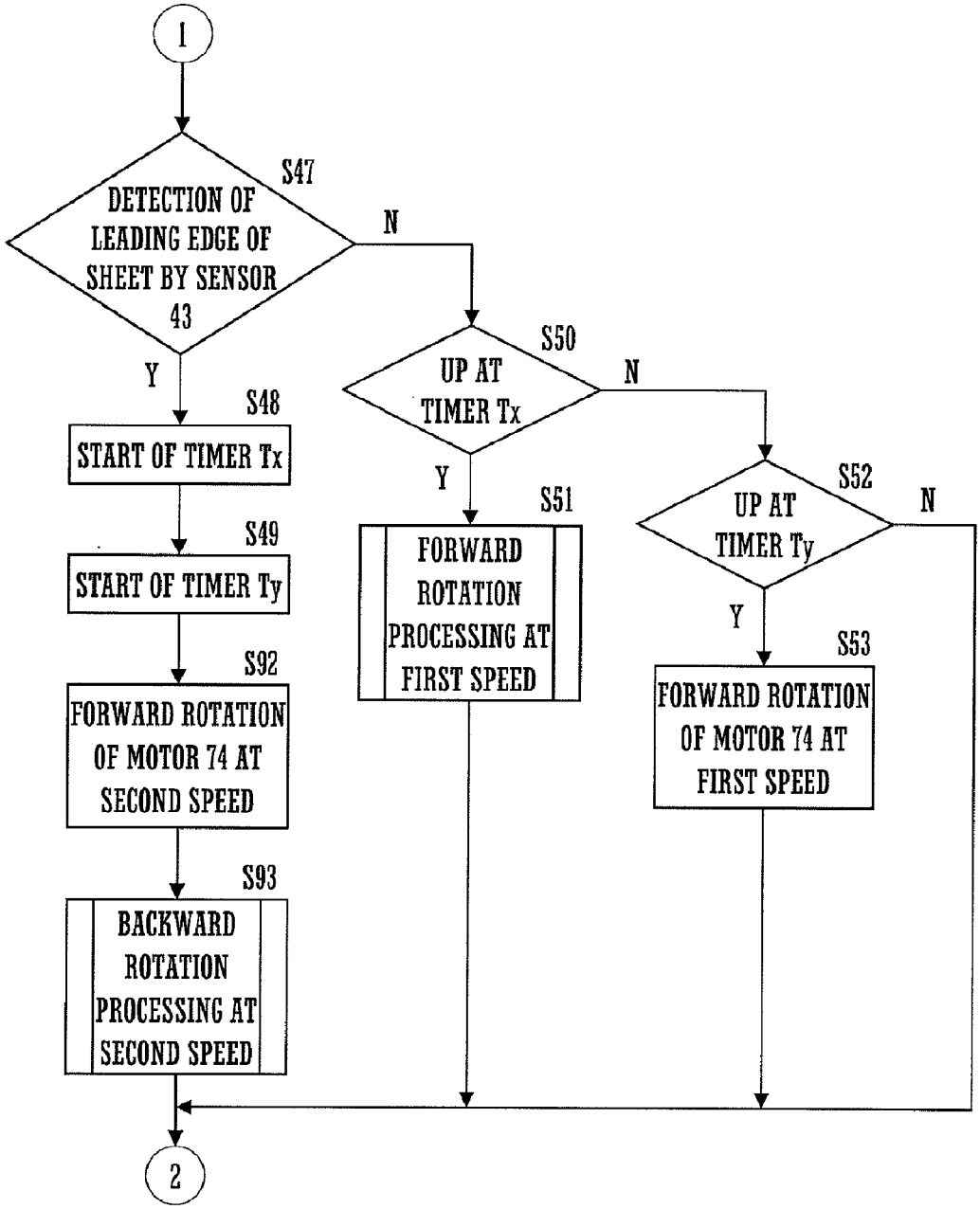
FIG. 21 is also a flow chart showing a procedure at the time of performing the sheet reversal processing in a sheet feeder according to another embodiment of the present invention.

It is to be noted the control portion 200 may perform the sheet reversal processing shown in FIG. 20 and FIG. 21 in place of the sheet reversal processing shown in FIG. 11 and FIG. 12. The following describes only the difference with the sheet reversal processing shown in FIG. 11 and FIG. 12, by taking as an example a case of feeding a sheet S with the A4 horizontal feed. It is also to be noted that the processing S31 to S43 in FIG. 20 and the processing S50 to S53 in FIG. 21 are the same as the processing S31 to S43 in FIG. 11 and the processing S50 to S53 in FIG. 12, respectively.

Figure 23A:
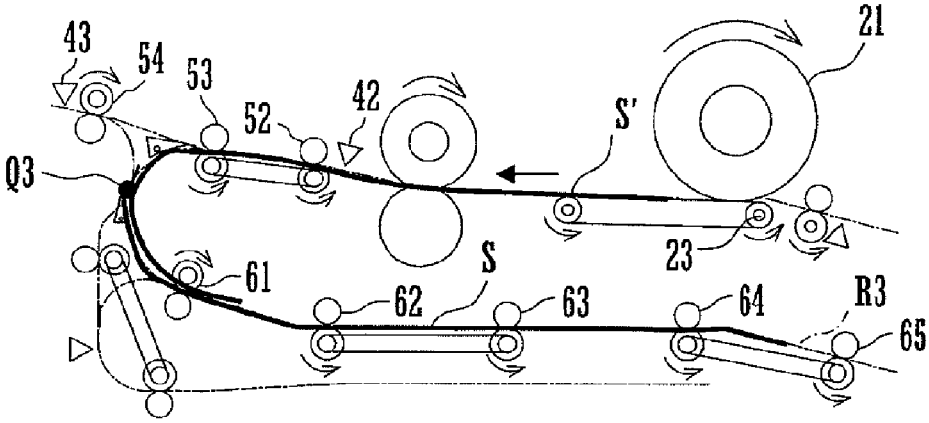
FIGS. 23A and 23B are transition views at the time of successively performing double-sided image formation processing to a plurality of large-sized sheets.

As shown in FIGS. 20 and 23A, the control portion 200, when the timer Tw is up, in other words, the rear end of the sheet S reaches the position Q3 (N in S31, N in S37, N in S42, and Y in S44), performs backward rotation processing at the first speed (S91).

Figure 22:
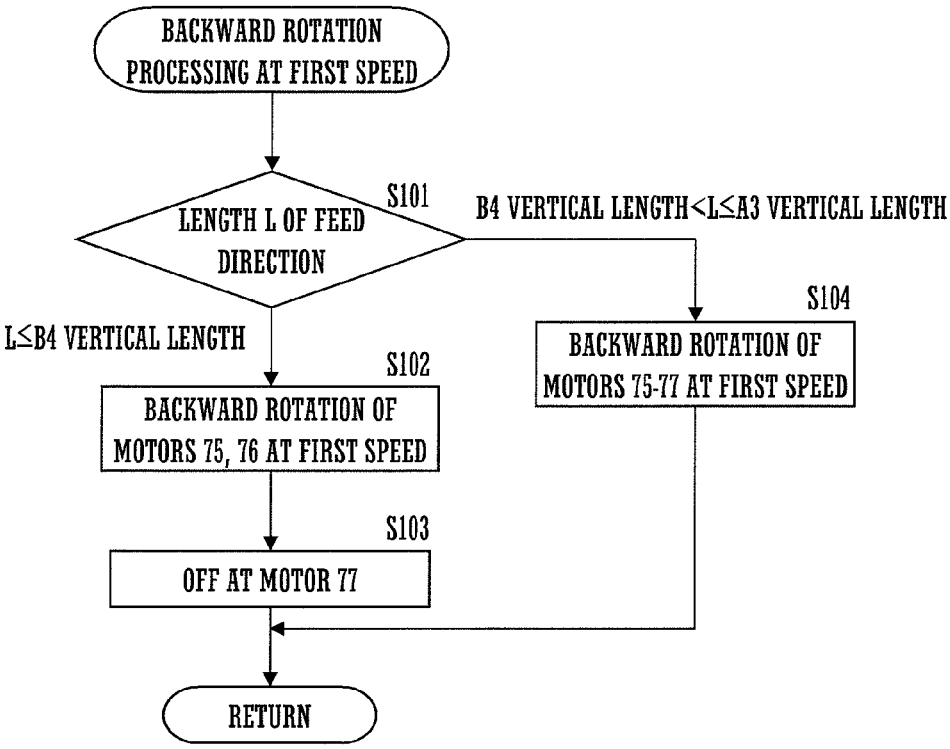
FIG. 22 is a flow chart at the time of performing the backward rotation processing of the first speed.

In the backward rotation processing at the first speed, as shown in FIG. 22, the control portion 200, when the length L (the A3 vertical length) of the feed direction of the sheet S is longer than the B4 vertical length (S101), backward rotates the pairs of forward and backward rotating rollers 61 to 65 through the motors 75 and 77 at the first speed (S104).

In a case that the length L of the feed direction of the sheet S is shorter than the B4 vertical length, the control portion 200 backward rotates the pairs of forward and backward rotating rollers 61 to 63 at the first speed through the motors 75 and 76 (S102). The control portion 200 supplies no electric power to the motor 77 (S103).

As shown in FIG. 23A, at a point of time when the rear end of the sheet S has reached the position Q3, the sheet S is positioned in the switch back path R3, and the control portion 200 reverses the pairs of forward and backward rotating rollers 61 to 65 at the first speed to feed the sheet S in the opposite direction.

Figure 23B:
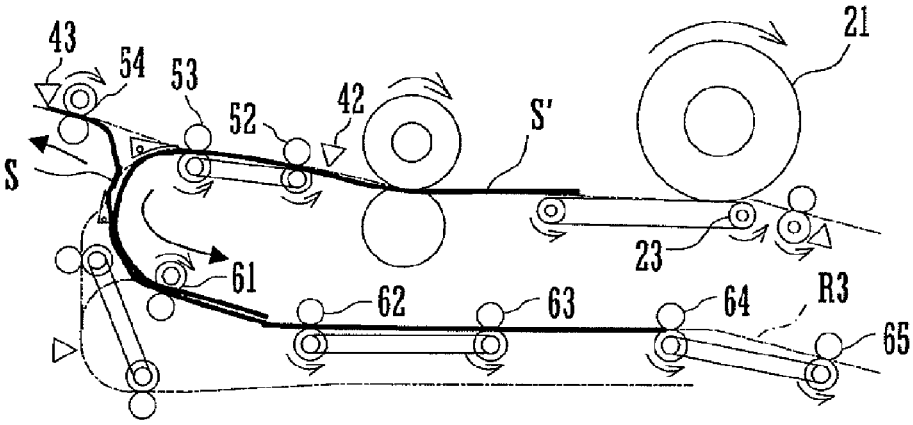

As shown in FIGS. 21 and 23B, the control portion 200, when the sensor 43 detects the leading edge of the sheet S (N in S31, N in S37, N in S42, N in S44, and Y in S47), starts the timer Tx and the timer Ty (S48, S49). The control portion 200 rotates the pair of feed rollers 54 at the second speed through the motor 74 (S92), and performs the backward rotation processing at the second speed (S93).

As shown in FIG. 23B, at the point of time when the sensor 43 detects the leading edge of the sheet S, the sheet S is reversed in the switch back path R3, and the leading edge thereof is nipped by the pair of feed rollers 54. The sheet S is fed by the pair of feed rollers 54 and the pairs of forward and backward rotating rollers 63 and 64 at the second feed speed. At this time, although rotating backwards at the second speed, the pairs of forward and backward rotating rollers 61 and 62 feed no sheet because the rollers are kept separated. At a point of time shown in FIG. 23A, since the leading edge of the sheet S is not nipped, the feeding force from the pairs of forward and backward rotating rollers 63 to 65 is not transmitted to the leading edge of sheet S, so that the sheet S may be buckled. Accordingly, the control portion 200 changes the feed speed for feeding a sheet S to the first feed speed slower than the second feed speed to prevent the sheet from being buckled. Then, the control portion 200, as shown in FIG. 23B, changes the feed speed of the sheet S to the second feed speed when the leading edge of the sheet S is nipped by the pair of feed rollers 54.

The sheet S is harder to be buckled as the length of the direction (a width direction of the sheet) perpendicular to the feed direction of the sheet is longer, and is more easily to be buckled as the distance from the leading edge of the sheet S to the part where the sheet is nipped by the pair of feed rollers or the pair of forward and backward rotating rollers is longer. For this reason, in a case where the length L of the feed direction of sheet S is longer than the B4 vertical length, the sheet is preferably fed at the first feed speed until the leading edge of the sheet S is nipped by the pair of feed rollers 54. Further, the sheet S may be fed at the first feed speed based on thickness information on the sheet detected at the time of feeding, and thickness information on the sheet S of which the operating portion 400 previously received input, and then buckling of the sheet S may be prevented.

It is to be noted that the foregoing embodiment has the separation portion 81 including the arm 811, the tension spring 812, and the solenoid 813. However, as shown in FIG. 24, the separation portion 81 may include a motor 814, a cam 815, and a gear 816 in place of the solenoid 813. Furthermore, the same applies to the separation portion 82.

In this case, the arm 811' is pivotably mounted to a substrate (not shown) at the side of the driven roller 61B of the switch back path R3, the arm having a first end as a pivot shaft 811A'. The driven roller 61B is mounted near the center of the arm 811'. At a second end of the arm 811', the tension spring 812 which gives the biasing force at the side of the driving roller 61A is mounted. The arm 811' includes the cam 815 disposed between the driven roller 61B and the tension spring 812. The cam 815 rotates when being driven by the motor 814 through the gear 816.

Figure 24A:
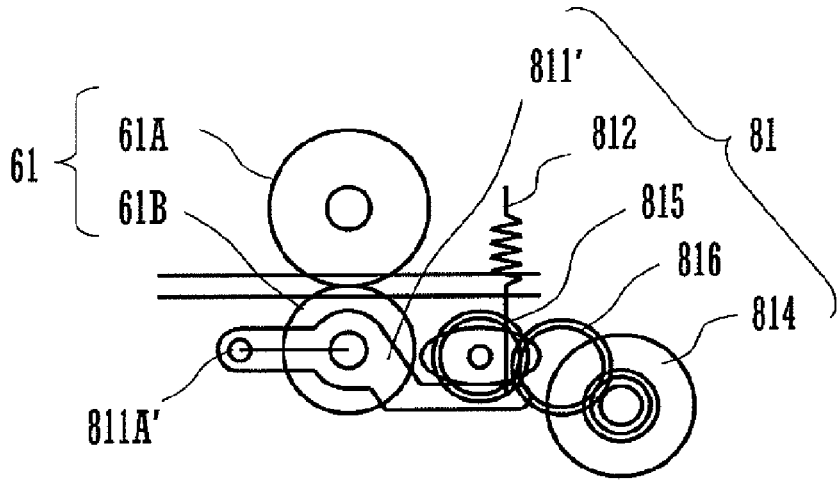
FIGS. 24A and 24B are views illustrating a contact/separation mechanism of a sheet feeder according to another embodiment of the present invention.
Figure 24B:
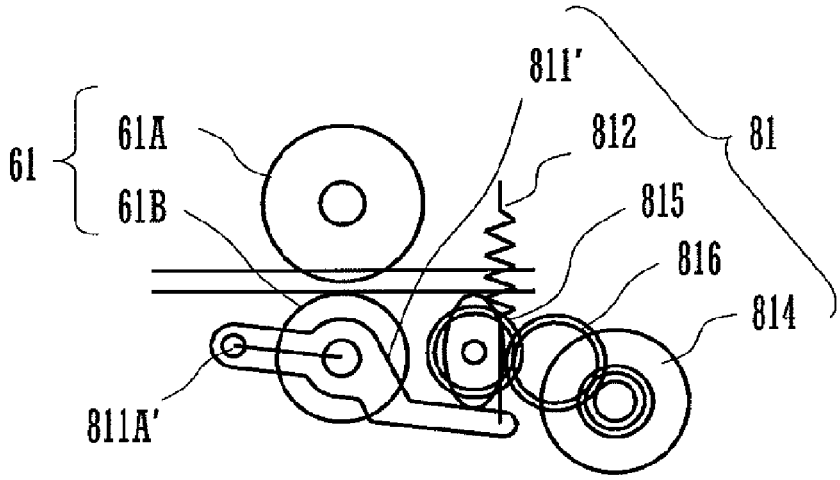

As shown in FIG. 24A, at the time of stop of an electric power supply to the motor 814, the driven roller 61B is in contact with the driving roller 61A since only the biasing force of the tension spring 812 acts on the arm 811'. The pair of forward and backward rotating rollers 61 is kept contacted. As shown in FIG. 24B, at the time of an electric power supply to the motor 814, in order that the cam 815 rotates and a force which is greater than the biasing force of the tension spring 812 and depresses to the opposite side the driving roller 61A side acts on the arm 811', the driven roller 61B is separated from the driving roller 61A. The pair of forward and backward rotating rollers 61 is kept separated.

As described above, the control portion 200 can keep the pair of forward and backward rotating rollers 61 separated or contacted only by switching the electric power supply to the motor 814 of the separation portion 81.

It is to be noted that the control portion 200 receives the length L of the feed direction of the sheet S from a personal computer. However, the control portion 200 may calculate a length L of the feed direction of a sheet S based on a detection signal of the sensor 41 disposed at the upstream side of the image forming unit 20. In this case, the control portion 200 calculates a length L of a sheet S in the feed direction based on: a time interval from a time when the sensor 41 detects the leading edge of the sheet S to a time when the sensor 41 detects the rear end of the sheet S; and the first feed speed at which the sheet S is fed.

It is also to be noted that the foregoing embodiment describes the control portion 200 making the sheet S and the succeeding sheet S' pass each other in the switch back path R3. However, in a case where sheets having low elasticity are fed, the control portion 200 keeps the pairs of forward and backward rotating rollers 61 and 62 contacted, and performs the feed control in which the sheets are passed one by one without making a sheet S and a succeeding sheet S' pass each other in the switch back path R3. The reason for this is that sheets having low elasticity are easy to jam. At this time, the control portion 200 receives a type of a sheet including sheets having different elasticity by the operating portion 400, and performs the feed control.

Furthermore, in the above described embodiments, an electrophotographic image forming apparatus is taken as an example; however, the present invention is also applicable to an image forming apparatus of another method, such as an inkjet method. In addition, the present invention can be applied to not only the switch back of a sheet in the face-down mode but also the switch back of a sheet of manuscript paper in an automatic document feeder and the switch back of a sheet in the double-sided printing mode. That is to say, the present invention is applicable to anything that reverses a first surface and a second surface of a sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the present invention.

What is claimed is:

1. A sheet feeder comprising:

a branch portion disposed at a part of a sheet feed path;

a switch back path, connected with the sheet feed path through the branch portion, for forward and backward feeding a sheet being fed in the sheet feed path in order to reverse a leading edge and a rear end of the sheet in a sheet feed direction in which the sheet is being fed via the branch portion;

a first feed member disposed at an upstream side of the branch portion in the sheet feed direction in the sheet feed path;

a second feed member disposed at a downstream side of the branch portion in the sheet feed direction in the sheet feed path;

a plurality of pairs of forward and backward rotating rollers disposed at the branch portion along the switch back path, the plurality of pairs of forward and backward rotating rollers having a first pair of forward and backward rotating rollers and a second pair of forward and backward rotating rollers that are disposed in this order from a side close to the branch portion, the first pair of forward and backward rotating rollers being supported freely in a contactable and separable manner and freely rotatably in forward and backward directions, and the second pair of forward and backward rotating rollers being supported freely rotatably in forward and backward directions;

a driving portion for selectively supplying, to the plurality of pairs of forward and backward rotating rollers, rotation in a forward rotation direction as a direction in which a sheet is fed into the switch back path, or rotation in a backward rotation direction as a direction in which a sheet is fed out of the switch back path;

a separation mechanism for separating the first pair of forward and backward rotating rollers from each other; and a control portion for controlling operation of the driving portion and the separation mechanism, the control portion being configured to operate the separation mechanism only in a case where a length of a sheet in the sheet feed direction is longer than a predetermined length and operate the driving portion so as to switch rotation of the plurality of pairs of forward and backward rotating rollers from a forward rotation to a backward rotation when the rear end of the sheet being fed in passes the branch portion, switch the rotation of the plurality of pairs of forward and backward rotating rollers from the backward rotation to the forward rotation when the rear end of the sheet being fed out passes the second pair of forward and backward rotating rollers in a case where the length of the sheet in the sheet feed direction is longer than the predetermined length, switch rotation of the plurality of pairs of forward and backward rotating rollers from the forward rotation to the backward rotation when the rear end of the sheet being fed in passes the branch portion, and switch the rotation of the plurality of pairs of forward and backward rotating rollers from the backward rotation to the forward rotation when the rear end of the sheet being fed out passes the second pair of forward and backward rotating rollers in a case where the length of the sheet in the sheet feed direction is longer than the predetermined length, wherein the predetermined length is set to either a longer distance of a distance from the first feed member to the second pair of forward and backward rotating rollers through the branch portion or a distance from the second pair of forward and backward rotating rollers to the second feed member through the branch portion.

2. The sheet feeder according to claim 1, wherein:

the plurality of pairs of forward and backward rotating rollers include a plurality of the first pairs of forward and backward rotating rollers disposed closer to the branch portion than to the second pair of forward and backward rotating rollers, along the switch back path;

the separation mechanism individually separates each of the plurality of first pairs of forward and backward rotating rollers;

the predetermined length includes a first predetermined length and a second predetermined length, the first predetermined length being set to either a longer distance of a distance from the first feed member to the second pair of forward and backward rotating rollers through the branch portion or a distance from the second pair of forward and backward rotating rollers to the second feed member through the branch portion, the second predetermined length being set to either a longer distance of a distance from the first feed member to a first pair of forward and backward rotating rollers farther from the branch portion than other first pairs of forward and backward rotating rollers or a distance from the first pair of forward and backward rotating rollers farther from the branch portion than other first pairs of forward and backward rotating rollers to the second feed member via the branch portion; and the control portion is configured to operate the separation mechanism so as to separate the plurality of first pairs of forward and backward rotating rollers from each other in a case where a length of the sheet in the sheet feed direction is longer than the first predetermined length, and separate only the first pair of forward and backward rotating rollers at a side closer to the branch portion than other first pairs of forward and backward rotating rollers in a case where a length of the sheet in the sheet feed direction is shorter than the first predetermined length and is longer than the second predetermined length, and to operate the driving portion so as to switch the rotation of the plurality of pairs of forward and backward rotating rollers from the backward rotation to the forward rotation when the rear end of the sheet being fed out passes the second pair of forward and backward rotating rollers in a case where the length of the sheet in the sheet feed direction is longer than the first predetermined length, switch the rotation of the plurality of pairs of forward and backward rotating rollers from the backward rotation to the forward rotation when the rear end of the sheet being fed out passes the first pair of forward and backward rotating rollers farther from the branch portion than the other first pairs of forward and backward rotating rollers in a case where the length of the sheet in the sheet feed direction is shorter than the first predetermined length and is longer than the second predetermined length, and switch the rotation of the plurality of pairs of forward and backward rotating rollers from the backward rotation to the forward rotation when the rear end of the sheet being fed out passes the first pair of forward and backward rotating rollers in a case where the length of the sheet in the sheet feed direction is shorter than the second predetermined length.

3. The sheet feeder according to claim 2, further comprising a detection member for detecting passage of a sheet at an upstream of the first feed member in the sheet feed direction, wherein the control portion calculates a length of a sheet in the sheet feed direction based on a detection result of the detection member.

4. The sheet feeder according to claim 2, wherein:

the driving portion supplies a feeding force for feeding a sheet to the first feed member and the second feed member from the upstream to the downstream of the sheet feed path, and the control portion is configured to operate the driving portion so that the second feed speed of the sheet in the switch back path by the first pair of forward and backward rotating rollers and the second pair of forward and backward rotating rollers becomes faster than the first feed speed of the sheet at the upstream of the first feed member in the sheet feed path during a period from a time when the rear end of the sheet being fed into the switch back path has reached the first feed member to a time when the leading edge of the sheet being fed out of the switch back path reaches the branch portion.

5. The sheet feeder according to claim 2, further comprising a receiving portion for receiving a designation of a type of a sheet to be fed in the sheet feed path, among a plurality of types of sheets having different elasticity, wherein the control portion is configured to operate the driving portion so that a leading edge of a succeeding sheet enters the branch portion after the rear end of the sheet being fed out of the switch back path passes the branch portion without operating the separation mechanism when the receiving portion receives a designation of a type of a sheet having low elasticity.

6. An image forming apparatus comprising:

an image forming portion for forming an image on a sheet being fed in the sheet feed path; and the sheet feeder according to claim 2, wherein the image forming portion is disposed at an upstream side of the sheet feeder.

7. The sheet feeder according to claim 1, further comprising a detection member for detecting passage of a sheet at an upstream of the first feed member in the sheet feed direction, wherein the control portion calculates a length of a sheet in the sheet feed direction based on a detection result of the detection member.

8. The sheet feeder according to claim 1, wherein:

the driving portion supplies a feeding force for feeding a sheet to the first feed member and the second feed member from the upstream to the downstream of the sheet feed path, and the control portion is configured to operate the driving portion so that the second feed speed of the sheet in the switch back path by the first pair of forward and backward rotating rollers and the second pair of forward and backward rotating rollers becomes faster than the first feed speed of the sheet at the upstream of the first feed member in the sheet feed path during a period from a time when the rear end of the sheet being fed into the switch back path has reached the first feed member to a time when the leading edge of the sheet being fed out of the switch back path reaches the branch portion.

9. The sheet feeder according to claim 1, further comprising a receiving portion for receiving a designation of a type of a sheet to be fed in the sheet feed path, among a plurality of types of sheets having different elasticity, wherein the control portion is configured to operate the driving portion so that a leading edge of a succeeding sheet enters the branch portion after the rear end of the sheet being fed out of the switch back path passes the branch portion without operating the separation mechanism when the receiving portion receives a designation of a type of a sheet having low elasticity.

10. An image forming apparatus comprising:

an image forming portion for forming an image on a sheet being fed in the sheet feed path; and the sheet feeder according to claim 1, wherein the image forming portion is disposed at an upstream side of the sheet feeder.

* * * * *